US009788698B2

(12) United States Patent
Morin et al.

(10) Patent No.: US 9,788,698 B2
(45) Date of Patent: Oct. 17, 2017

(54) DEBRIS EVACUATION FOR CLEANING ROBOTS

(71) Applicant: iRobot Corporation, Bedford, MA (US)

(72) Inventors: Russell Walter Morin, Tewksbury, MA (US); Harold Boeschenstein, Boston, MA (US); Faruk Bursal, Boston, MA (US); Chris Grace, Stoneham, MA (US)

(73) Assignee: iRobot Corporation, Bedford, MA (US)

( * ) Notice: Subject to any disclaimer, the term of this patent is extended or adjusted under 35 U.S.C. 154(b) by 322 days.

(21) Appl. No.: 14/566,243

(22) Filed: Dec. 10, 2014

(65) Prior Publication Data

US 2016/0166126 A1 Jun. 16, 2016

(51) Int. Cl.

| | |
|---|---|
| ***A47L 9/28*** | (2006.01) |
| ***A47L 9/10*** | (2006.01) |
| ***A47L 7/00*** | (2006.01) |

(52) U.S. Cl.

CPC ..... *A47L 9/2805* (2013.01); *A47L 7/0004* (2013.01); *A47L 9/106* (2013.01); *A47L 2201/024* (2013.01)

(58) Field of Classification Search

CPC .. A47L 2201/00; A47L 9/2805; A47L 7/0004; A47L 9/0106

See application file for complete search history.

(56) References Cited

U.S. PATENT DOCUMENTS

| | | | |
|---|---|---|---|
| 2,770,825 | A | 11/1956 | Pullen |
| 5,345,649 | A | 9/1994 | Whitlow |

(Continued)

FOREIGN PATENT DOCUMENTS

| | | | |
|---|---|---|---|
| DE | 102004041021 | B3 | 8/2005 |
| EP | 1961358 | A2 | 8/2008 |

(Continued)

OTHER PUBLICATIONS

International Search Report and Written Opinion in International Application No. PCT/US2015/050565, dated Nov. 24, 2015, 16 pages.

(Continued)

*Primary Examiner* — Robert Scruggs
(74) *Attorney, Agent, or Firm* — Fish & Richardson P.C.

(57) ABSTRACT

A robot floor cleaning system features a mobile floor cleaning robot and an evacuation station. The robot includes: a chassis with at least one drive wheel operable to propel the robot across a floor surface; a cleaning bin disposed within the robot and arranged to receive debris ingested by the robot during cleaning; and a robot vacuum configured to pull debris into the cleaning bin from an opening on an underside of the robot. The evacuation station is configured to evacuate debris from the cleaning bin of the robot, and includes: a housing defining a platform arranged to receive the cleaning robot in a position in which the opening on the underside of the robot aligns with a suction opening defined in the platform; and an evacuation vacuum in fluid communication with the suction opening and operable to draw air into the evacuation station housing through the suction opening.

43 Claims, 18 Drawing Sheets

(56) References Cited

U.S. PATENT DOCUMENTS

| | | | | |
|---|---|---|---|---|
| 5,787,545 | A | 8/1998 | Colens | |
| 5,959,423 | A | 9/1999 | Nakanishi et al. | |
| 5,995,884 | A | 11/1999 | Allen et al. | |
| 6,076,226 | A | 6/2000 | Reed | |
| 6,094,775 | A | 8/2000 | Behmer | |
| 6,389,329 | B1 | 5/2002 | Colens | |
| 6,532,404 | B2 | 3/2003 | Colens | |
| 6,552,729 | B1 | 4/2003 | DiBernardo et al. | |
| 6,594,844 | B2 | 7/2003 | Jones | |
| 6,690,134 | B1 | 2/2004 | Jones et al. | |
| 6,781,338 | B2 | 8/2004 | Jones et al. | |
| 6,809,490 | B2 | 10/2004 | Jones et al. | |
| 6,965,209 | B2 | 11/2005 | Jones et al. | |
| 7,155,308 | B2 | 12/2006 | Jones | |
| 7,173,391 | B2 | 2/2007 | Jones et al. | |
| 7,388,343 | B2 | 6/2008 | Jones et al. | |
| 7,389,156 | B2 | 6/2008 | Ziegler et al. | |
| 7,448,113 | B2 | 11/2008 | Jones et al. | |
| 7,571,511 | B2 | 8/2009 | Jones et al. | |
| 7,636,982 | B2 | 12/2009 | Jones et al. | |
| 7,663,333 | B2 | 2/2010 | Jones et al. | |
| 7,706,917 | B1 | 4/2010 | Chiappetta et al. | |
| 7,720,554 | B2 | 5/2010 | DiBernardo et al. | |
| 7,761,954 | B2 | 7/2010 | Ziegler et al. | |
| 7,801,645 | B2 | 9/2010 | Taylor et al. | |
| 7,805,220 | B2 | 9/2010 | Taylor et al. | |
| 8,239,992 | B2 | 8/2012 | Schnittman et al. | |
| 8,387,193 | B2 | 3/2013 | Ziegler et al. | |
| 8,661,605 | B2 | 3/2014 | Svendsen et al. | |
| 2002/0016649 | A1 | 2/2002 | Jones | |
| 2002/0120364 | A1 | 8/2002 | Colens | |
| 2002/0124343 | A1 | 9/2002 | Reed | |
| 2002/0189871 | A1 | 12/2002 | Won | |
| 2003/0025472 | A1 | 2/2003 | Jones et al. | |
| 2004/0020000 | A1 | 2/2004 | Jones | |
| 2004/0049877 | A1 | 3/2004 | Jones et al. | |
| 2004/0187457 | A1 | 9/2004 | Colens | |
| 2004/0207355 | A1 | 10/2004 | Jones et al. | |
| 2004/0255425 | A1 | 12/2004 | Arai et al. | |
| 2005/0015920 | A1 | 1/2005 | Kim et al. | |
| 2005/0067994 | A1 | 3/2005 | Jones et al. | |
| 2005/0132680 | A1 | 6/2005 | Wegelin et al. | |
| 2005/0150519 | A1* | 7/2005 | Keppler | A47L 5/38 134/19 |
| 2005/0183229 | A1 | 8/2005 | Uehigashi | |
| 2005/0204717 | A1 | 9/2005 | Colens | |
| 2007/0157415 | A1 | 7/2007 | Lee et al. | |
| 2007/0157420 | A1 | 7/2007 | Lee et al. | |
| 2007/0226949 | A1* | 10/2007 | Hahm | A47L 9/009 15/340.1 |
| 2007/0245511 | A1 | 10/2007 | Hahm et al. | |
| 2008/0052846 | A1 | 3/2008 | Kapoor et al. | |
| 2008/0134458 | A1 | 6/2008 | Ziegler et al. | |
| 2008/0140255 | A1 | 6/2008 | Ziegler et al. | |
| 2008/0155768 | A1 | 7/2008 | Ziegler et al. | |
| 2008/0282494 | A1 | 11/2008 | Won et al. | |
| 2009/0044370 | A1 | 2/2009 | Won et al. | |
| 2009/0049640 | A1* | 2/2009 | Lee | A47L 9/20 15/319 |
| 2010/0011529 | A1 | 1/2010 | Won et al. | |
| 2010/0049365 | A1 | 2/2010 | Jones et al. | |
| 2010/0107355 | A1 | 5/2010 | Won et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2012/0090126 | A1 | 4/2012 | Kim et al. | |

FOREIGN PATENT DOCUMENTS

| | | | |
|---|---|---|---|
| EP | 1980188 | A2 | 10/2008 |
| ES | 2238196 | | 8/2005 |
| WO | 2005006935 | | 1/2005 |
| WO | 2005055795 | | 6/2005 |
| WO | 2012149572 | A2 | 11/2012 |

OTHER PUBLICATIONS

*Deebot D77 Instruction Manual*, EcoVacs Robotics, Inc., Copyright 2013, 20 pages.

Hunt, Articles.courant.com [online]. "Kevin Hunt: Review: Ecovacs Deebot robotic vacuum," dated Apr. 28, 2014 [retrieved Jan. 21, 2015]. Retrieved from the Internet: URL <http://articles.courant.com/2014-04-28/business/hc-hunt-sc-cons-0424-tech-deebot-20140428-15__1__roomba-neato-robotics-mode>, 3 pages.

Mankoo, NewLaunches.com [online]. "Samsung NaviBot S vacuum cleaning robot makes your old sucker look near-extinction," dated Sep. 5, 2011 [retrieved on Jan. 21, 2015]. Retrieved from the Internet: URL <http://newlaunches.com/archives/samsung__navibot__s__vacuum__cleaning__robot__makes__your__old__sucker__look__nearextinction.php>, 5 pages.

Prindle, DigitalTrends.com [online]. "Toshiba's New Robo-Vacuum Has a Self Emptying Bin," dated Aug. 27, 2014 [retrieved on Jan. 7, 2015]. Retrieved from the Internet: URL http://www.digitaltrends.com/hom/toshiba-robotic-vacuum-self-emptying-bin>, 4 pages.

International Preliminary Report on Patentability in International Application No. PCT/US2015/050565, dated Jun. 13, 2017.

* cited by examiner

DEBRIS EVACUATION FOR CLEANING ROBOTS

TECHNICAL FIELD

This disclosure relates to robotic cleaning systems, and more particularly to systems, apparatus and methods for removing debris from cleaning robots.

BACKGROUND

Autonomous cleaning robots are robots which can perform desired cleaning tasks, such as vacuum cleaning, in unstructured environments without continuous human guidance. Many kinds of cleaning robots are autonomous to some degree and in different ways. For example, an autonomous cleaning robot may be designed to automatically dock with a base station for the purpose of emptying its cleaning bin of vacuumed debris.

SUMMARY

In one aspect of the present disclosure, a robot floor cleaning system features a mobile floor cleaning robot and an evacuation station. The robot includes: a chassis with at least one drive wheel operable to propel the robot across a floor surface; a cleaning bin disposed within the robot and arranged to receive debris ingested by the robot during cleaning; and a robot vacuum including a motor and a fan connected to the motor and configured to generate a flow of air to pull debris into the cleaning bin from an opening on an underside of the robot. The evacuation station is configured to evacuate debris from the cleaning bin of the robot, and includes: a housing defining a platform arranged to receive the cleaning robot in a position in which the opening on the underside of the robot aligns with a suction opening defined in the platform; and an evacuation vacuum in fluid communication with the suction opening and operable to draw air into the evacuation station housing through the suction opening. The floor cleaning robot may further include a one-way air flow valve disposed within the robot and configured to automatically close in response to operation of the vacuum of the evacuation station. The air flow valve may be disposed in an air passage connecting the robot vacuum to the interior of the cleaning bin.

In some embodiments, the air flow valve is located within the robot such that, with the air flow valve in a closed position, the fan is substantially sealed from the interior of the cleaning bin.

In some embodiments, operation of the evacuation vacuum causes a reverse airflow to pass through the cleaning bin, carrying dirt and debris from the cleaning bin, through the suction opening, and into the housing of the evacuation station.

In some embodiments, the cleaning bin includes: at least one opening along a wall of the cleaning bin; and a sealing member mounted to the wall of the cleaning bin in alignment with the at least one opening. In some examples, the at least one opening includes one or more suction vents located along a rear wall of the cleaning bin. In some examples, the at least one opening includes an exhaust port located along a side wall of the cleaning bin proximate the robot vacuum. In some examples, the sealing member includes a flexible and resilient flap adjustable from a closed position to an open position in response to operation of the vacuum of the evacuation station. In some examples, the sealing member includes an elastomeric material.

In some embodiments, the robot further includes a cleaning head assembly disposed in the opening on the underside of the robot, the cleaning head including a pair of rollers positioned adjacent one another to form a gap therebetween. Thus, operation of the evacuation vacuum can cause a reverse airflow to pass from the cleaning bin to pass through the gap between the rollers.

In some embodiments, the evacuation station further includes a robot-compatibility sensor responsive to a metallic plate located proximate a base of the cleaning bin. In some examples, the robot-compatibility sensor includes an inductive sensing component.

In some embodiments, the evacuation station further includes: a debris canister detachably coupled to the housing for receiving debris carried by air drawn into the evacuation station housing by the evacuation vacuum through the suction opening, and a canister sensor responsive to the attachment and detachment of the debris canister to and from the housing. In some examples, the evacuation station further includes: at least one debris sensor responsive to debris entering the canister via air drawn into the evacuation station housing; and a controller coupled to the debris sensor, the controller configured to determine a fullness state of the canister based on feedback from the debris sensor. In some examples, the controller is configured to determine the fullness state as a percentage of the canister that is filled with debris.

In some embodiments, the evacuation station further includes: a motor-current sensor responsive to operation of the robot vacuum; and a controller coupled to the motor-current sensor, the controller configured to determine an operational state of a filter proximate the robot vacuum based on sensory feedback from the motor-current sensor.

In some embodiments, the evacuation station further includes a wireless communications system coupled to a controller, and configured to communicate information describing a status of the evacuation station to a mobile device.

In another aspect of the present disclosure, a method of evacuating a cleaning bin of an autonomous floor cleaning robot includes the step of docking a mobile floor cleaning robot to a housing of an evacuation station. The mobile floor cleaning robot includes: a cleaning bin disposed within the robot and carrying debris ingested by the robot during cleaning; and a robot vacuum including a motor and a fan connected to the motor. The evacuation station includes: a housing defining a platform having a suction opening; and an evacuation vacuum in fluid communication with the suction opening and operable to draw air into the evacuation station housing through the suction opening. The method may further include the steps of: sealing the suction opening of the platform to an opening on an underside of the robot; drawing air into the evacuation station housing through the suction opening by operating the evacuation vacuum; and actuating a one-way air flow valve disposed within the robot to inhibit air from being drawn through the fan of the robot vacuum by operation of the evacuation vacuum.

In some embodiments, actuating the air flow valve includes pulling a flap of the valve in an upward pivoting motion via a suction force of the evacuation vacuum. In some examples, actuating the air flow valve further includes substantially sealing an air passage connecting the robot vacuum to the interior cleaning bin with the flap.

In some embodiments, drawing air into the evacuation station by operating the evacuation vacuum further includes drawing a reverse airflow through the robot, the reverse airflow carrying dirt and debris from the cleaning bin, through the suction opening, and into the housing of the evacuation station. In some examples, the robot further includes a cleaning head assembly disposed in the opening on the underside of the robot, the cleaning head including a pair of rollers positioned adjacent one another to form a gap therebetween. Thus, drawing a reverse airflow through the robot can include routing the reverse airflow from the cleaning bin to pass through the gap between the rollers.

In some embodiments, drawing air into the evacuation station by operating the evacuation vacuum further includes pulling a flap of a sealing member away from an opening along a wall of the cleaning bin via a suction force of the evacuation vacuum. In some examples, the opening includes one or more suction vents located along a rear wall of the cleaning bin. In some examples, the opening includes an exhaust port located along a side wall of the cleaning bin proximate the robot vacuum.

In some embodiments, the method further includes the steps of: monitoring a robot-compatibility sensor responsive to the presence of a metallic plate located proximate a base of the cleaning bin; and in response to detecting the presence of the metallic plate, initiating operation of the evacuation vacuum. In some examples, the robot-compatibility sensor includes an inductive sensing component.

In some embodiments, the method further includes the steps of: monitoring at least one debris sensor responsive to debris entering a detachable canister of the evacuation station via air drawn into the evacuation station housing to detect a fullness state of the canister; and in response to determining that the canister is substantially full based on the fullness state, inhibiting operation of the evacuation vacuum.

In some embodiments, the method further includes the steps of: monitoring a motor-current sensor responsive to operation of the robot vacuum to detect an operational state of a filter proximate the robot vacuum; and in response to determining that the filter is dirty, providing a visual indication of the operational state of the filter to a user via a communications system.

In yet another aspect of the present disclosure, a mobile floor cleaning robot includes: a chassis with at least one drive wheel operable to propel the robot across a floor surface; a cleaning bin disposed within the robot and arranged to receive debris ingested by the robot during cleaning; a robot vacuum including a motor and a fan connected to the motor and configured to motivate air to flow along a flow path extending from an inlet on an underside of the robot, through the cleaning bin, to an outlet, thereby pulling debris through the inlet into the cleaning bin; and a one-way air flow valve disposed within the robot and configured to automatically close in response to air flow moving along the flow path from the outlet to the inlet.

In some embodiments, the air flow valve is located within the robot such that, with the air flow valve in a closed position, the fan is substantially sealed from the interior of the cleaning bin.

In some embodiments, the cleaning bin includes: at least one opening along a wall of the cleaning bin; and a sealing member mounted to the wall of the cleaning bin in alignment with the at least one opening. In some examples, the at least one opening includes one or more suction vents located along a rear wall of the cleaning bin. In some examples, the at least one opening includes an exhaust port located along a side wall of the cleaning bin proximate the robot vacuum. In some examples, the sealing member includes a flexible and resilient flap adjustable from a closed position to an open position in response to a suction force. In some examples, the sealing member includes an elastomeric material.

In some embodiments, the robot further includes a cleaning head assembly disposed in an opening on the underside of the robot, the cleaning head including a pair of rollers positioned adjacent one another to form a gap therebetween configured to receive a forward airflow carrying debris to the cleaning bin during cleaning operations of the robot and a reverse airflow carrying debris from the cleaning bin during evacuation operations of the robot.

In yet another aspect of the present disclosure, a cleaning bin for use with a mobile robot includes: a frame attachable to a chassis of a mobile robot, the frame defining a debris collection cavity and including a vacuum housing and a rear wall having one or more suction vents; a vacuum sealing member coupled to the frame in an air passage proximate the vacuum housing, and an elongated sealing member coupled to the frame proximate the rear wall in alignment with the suction vents. The vacuum sealing member may include a flexible and resilient flap adjustable from an position to a closed position in response to a reverse suction airflow out of the cleaning bin. The elongated sealing member may include a flexible and resilient flap adjustable from a closed position to an open position in response to the reverse suction airflow.

In some embodiments, the cleaning bin further includes an auxiliary sealing member located along a side wall of the frame in alignment with an exhaust port proximate a lower portions of the vacuum housing. The auxiliary sealing member may be adjustable from a closed position to an open position in response to the reverse suction airflow.

In some embodiments, the vacuum housing is oriented at an oblique angle, such that an air intake of a robot vacuum supported within the vacuum housing is tilted relative to the air passage of the frame.

In some embodiments, the flexible and resilient flap of at least one of the vacuum sealing member and the elongated sealing member includes an elastomeric material.

In some embodiments, the flexible and resilient flap of the vacuum sealing member is located with the air passage such that, with the flap in a closed position, a fan of a robot vacuum supported within the vacuum housing is substantially sealed from the debris collection cavity.

In some embodiments, the cleaning bin further includes a passive roller mounted along a bottom surface of the frame.

In some embodiments, the cleaning bin further includes a bin detection system configured to sense an amount of debris present in the debris collection cavity, the bin detection system including at least one debris sensor coupled to a microcontroller.

Further details of one or more embodiments of the invention are set forth in the accompanying drawings and the description below. Other features, objects, and advantages of the invention will be apparent from the description and drawings, and from the claims.

DESCRIPTION OF DRAWINGS

Similar reference numbers in different figures may indicate similar elements.

DETAILED DESCRIPTION

Figure 1:
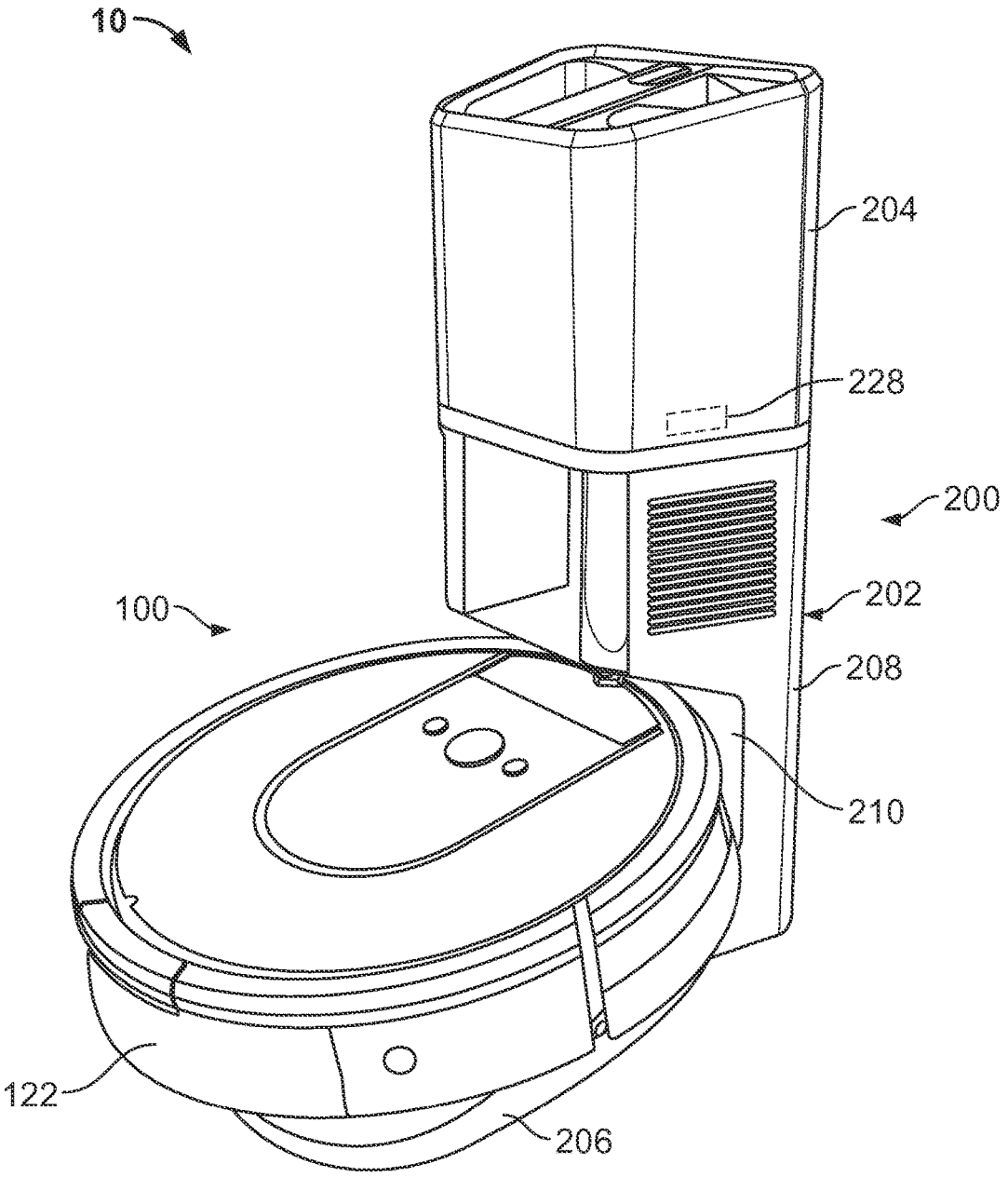
FIG. 1 is a perspective view of a floor cleaning system including a cleaning robot and an evacuation station.

FIG. 1 illustrates a robotic floor cleaning system 10 featuring a mobile floor cleaning robot 100 and an evacuation station 200. In some embodiments, the robot 100 is designed to autonomously traverse and clean a floor surface by collecting debris from the floor surface in a cleaning bin 122. In some embodiments, when the robot 100 detects that the cleaning bin 122 is full, it may navigate to the evacuation station 200 to have the cleaning bin 122 emptied.

The evacuation station 200 includes a housing 202 and a removable debris canister 204. The housing 202 defines a platform 206 and a base 208 that supports the debris canister 204. As shown in FIG. 1, the robot 100 can dock with the evacuation station 200 by advancing onto the platform 206 and into a docking bay 210 of the base 208. Once the docking bay 210 receives the robot 100, an evacuation vacuum (e.g., evacuation vacuum 212 shown in FIG. 5A) carried within the base 208 draws debris from the cleaning bin 122 of the robot 100, through the housing 202, and into the debris canister 204. The evacuation vacuum 212 includes a fan 213 and a motor (see FIG. 5A) for drawing air through the evacuation station 200 and the docked robot 100 during an evacuation cycle.

Figure 2:
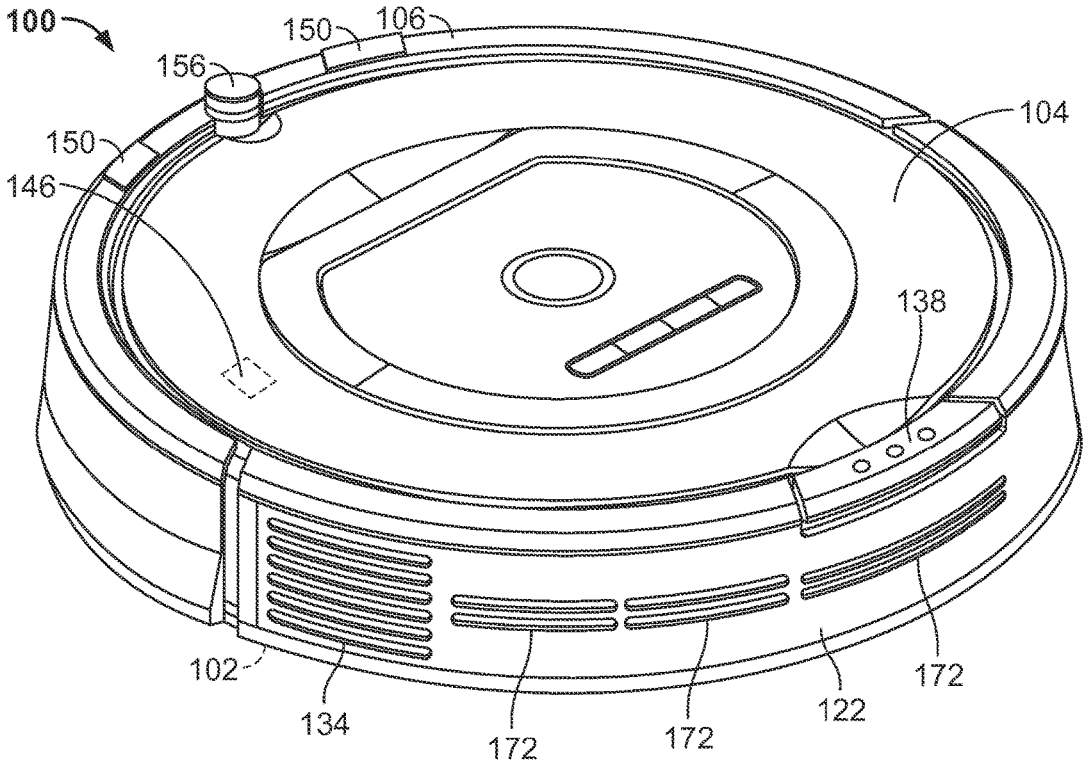
FIG. 2 is a perspective view of an example cleaning robot.
Figure 3:
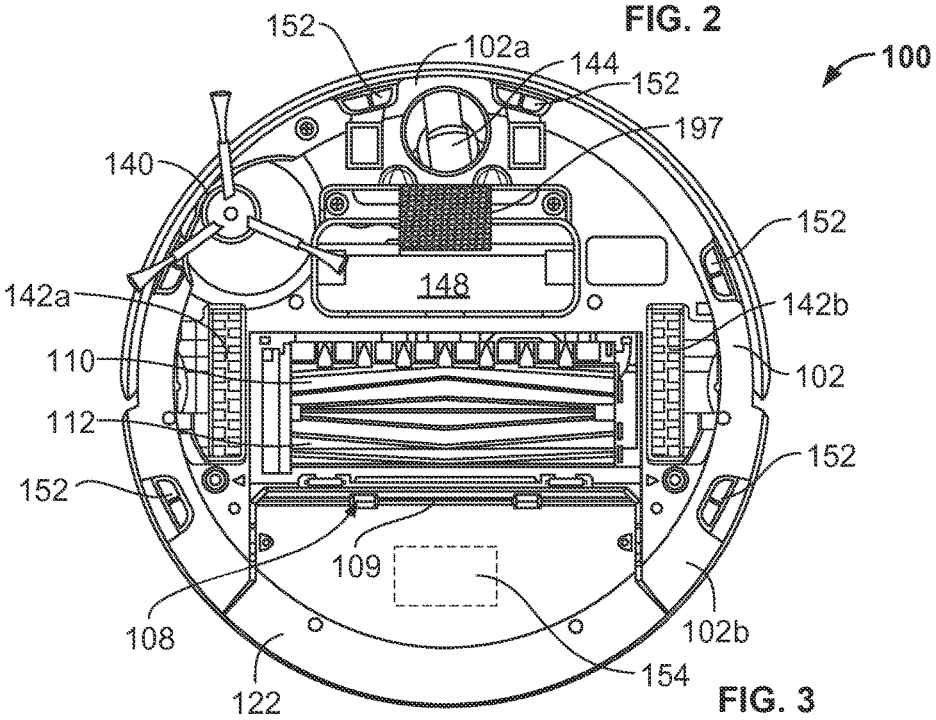
FIG. 3 is a bottom view of the robot of FIG. 2.

FIGS. 2 and 3 illustrate an example mobile floor cleaning robot 100 that may be employed in the cleaning system 10 shown in FIG. 1. In this example, the robot 100 includes a main chassis 102 which carries an outer shell 104. The outer shell 104 of the robot 100 couples a movable bumper 106 (see FIG. 2) to the chassis 102. The robot 100 may move in forward and reverse drive directions; consequently, the chassis 102 has corresponding forward and back ends, 102*a* and 102*b* respectively. The forward end 102*a* at which the bumper 106 is mounted faces the forward drive direction. In some embodiments, the robot 100 may navigate in the reverse direction with the back end 102*b* oriented in the direction of movement, for example during escape, bounce, and obstacle avoidance behaviors in which the robot 100 drives in reverse.

Figure 4:
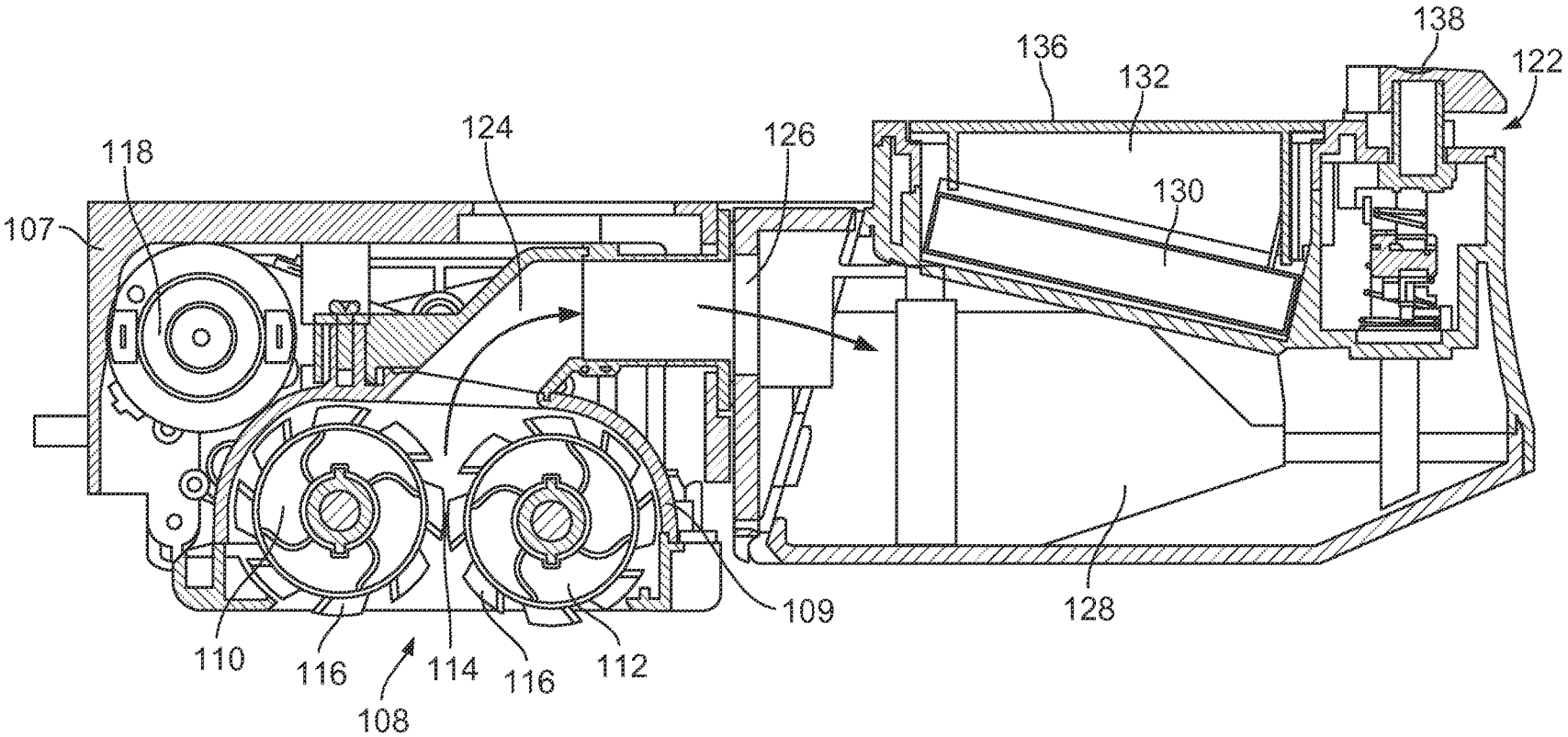
FIG. 4 is a cross-sectional side view of a portion of the cleaning robot including a cleaning head assembly and a cleaning bin.

A cleaning head assembly 108 is located in a roller housing 109 coupled to a middle portion of the chassis 102. As shown in FIG. 4, the cleaning head assembly 108 is mounted in a cleaning head frame 107 attachable to the chassis 102. The cleaning head frame 107 supports the roller housing 109. The cleaning head assembly 108 includes a front roller 110 and a rear roller 112 rotatably mounted parallel to the floor surface and spaced apart from one another by a small elongated gap 114. The front 110 and rear 112 rollers are designed to contact and agitate the floor surface during use. Thus, in this example, each of the rollers 110, 112 features a pattern of chevron-shaped vanes 116 distributed along its cylindrical exterior. Other suitable configurations, however, are also contemplated. For example, in some embodiments, at least one of the front and rear rollers may include bristles and/or elongated pliable flaps for agitating the floor surface.

Each of the front 110 and rear 112 rollers is rotatably driven by a brush motor 118 to dynamically lift (or "extract") agitated debris from the floor surface. A robot vacuum (e.g., the robot vacuum 120 shown in see FIGS. 6, 12, and 14-18) disposed in a cleaning bin 122 towards the back end 102*b* of the chassis 102 includes a motor driven fan (e.g., the fan 195 shown in FIGS. 14-16) that pulls air up through the gap 114 between the rollers 110, 112 to provide a suction force that assists the rollers in extracting debris from the floor surface. Air and debris that passes through the gap 114 is routed through a plenum 124 that leads to an opening 126 of the cleaning bin 122. The opening 126 leads to a debris collection cavity 128 of the cleaning bin 122. A filter 130 located above the cavity 128 screens the debris from an air passage 132 leading to the air intake of the robot vacuum (e.g., the air intake 121 shown in FIGS. 13-16 and 18).

Figure 14:
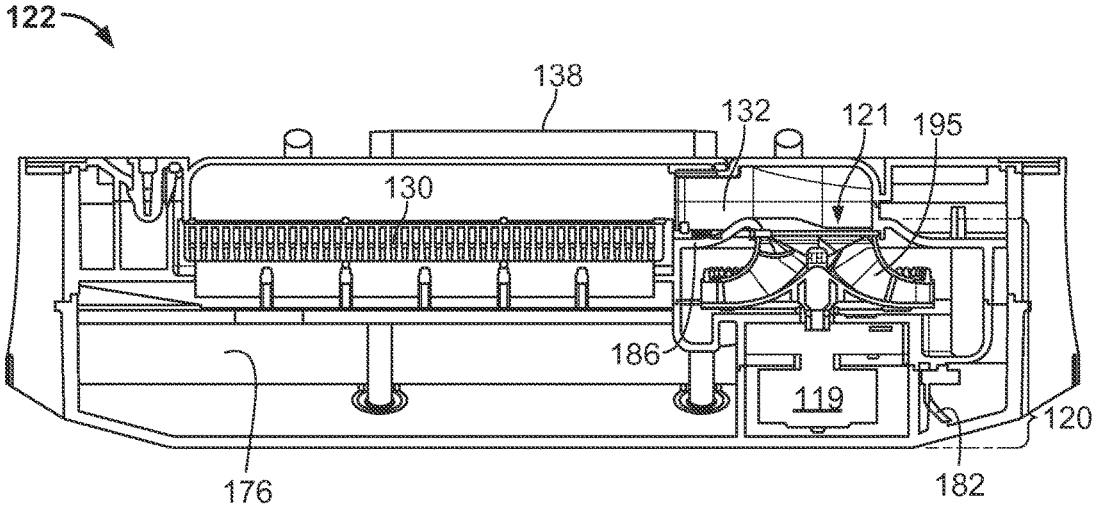
FIG. 14 is a cross-sectional front view of the first example cleaning bin illustrating the installation of the elongated sealing member, the auxiliary sealing member, and the vacuum sealing member.
Figure 15A:
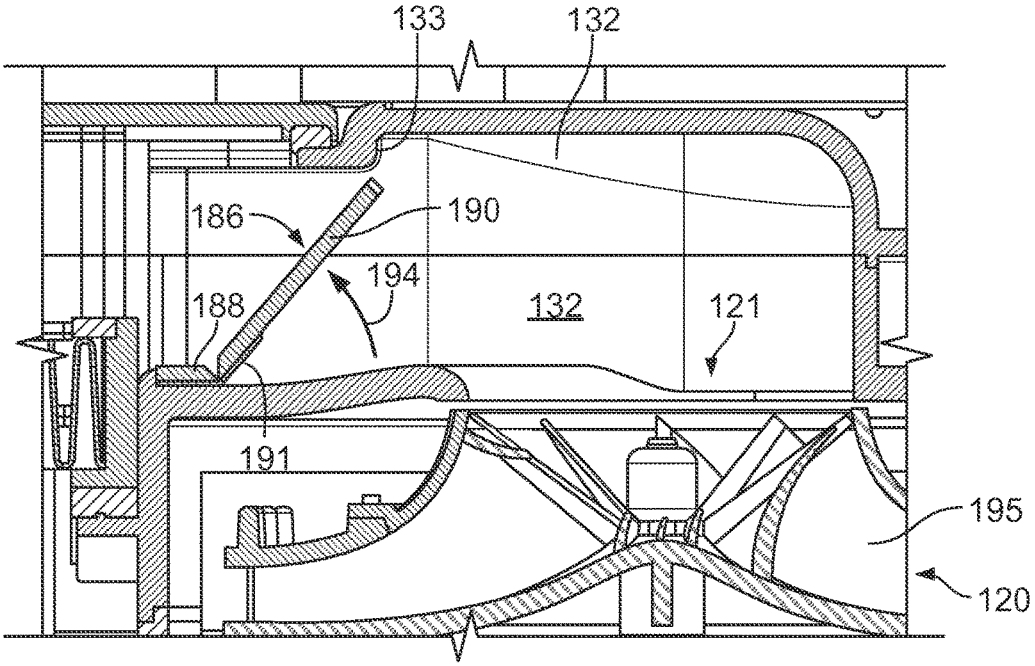
FIG. 15A is a cross-sectional side view of the air passage leading to the air intake of the robot vacuum illustrating the vacuum sealing member in a closed position.
Figure 15B:
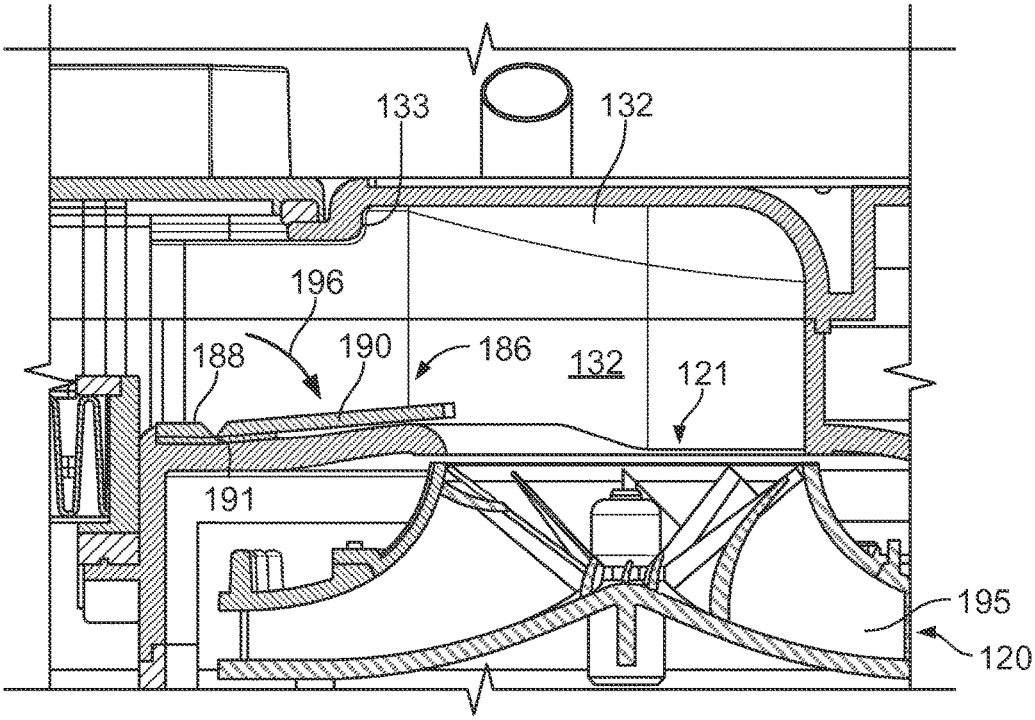
FIG. 15B is a cross-sectional side view of the air passage leading to the air intake of the robot vacuum illustrating the vacuum sealing member in an open position.
Figure 16:
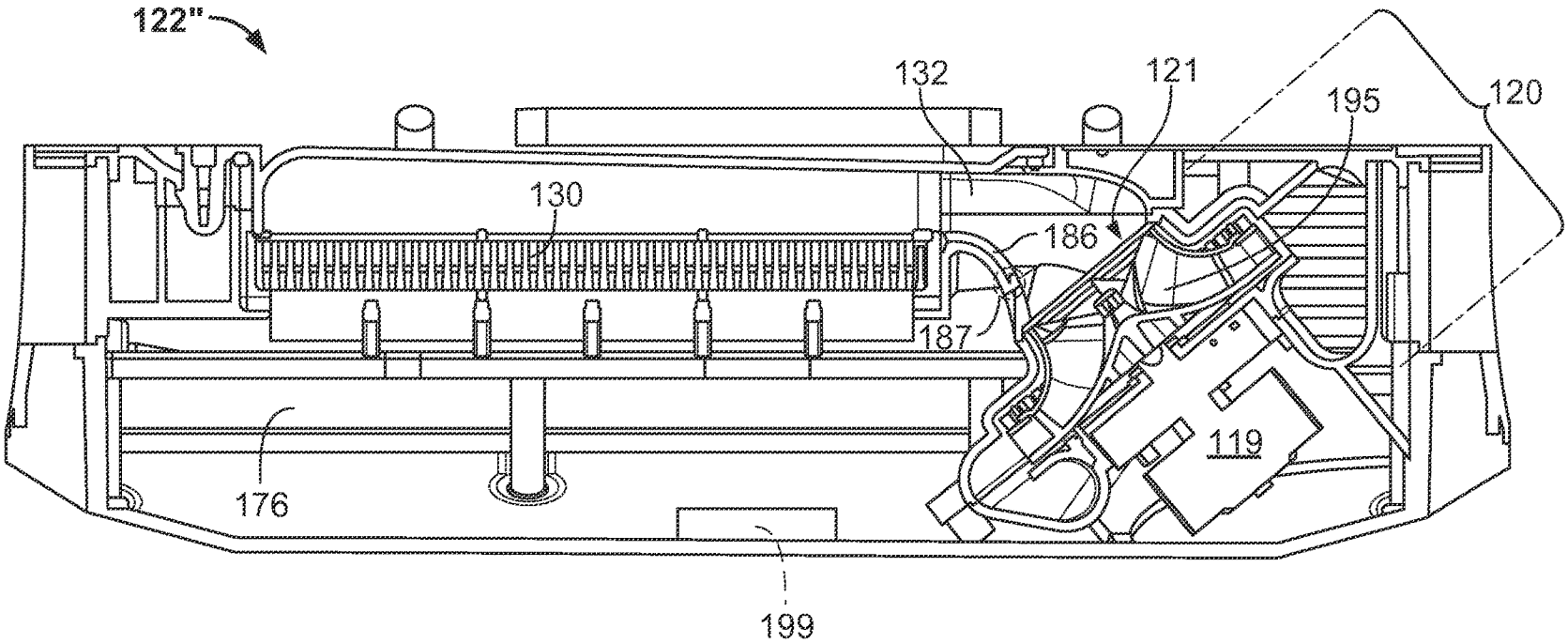
FIG. 16 is a cross-sectional front view of a second example cleaning bin illustrating the installation of the elongated sealing member and the vacuum sealing member.
Figure 17:
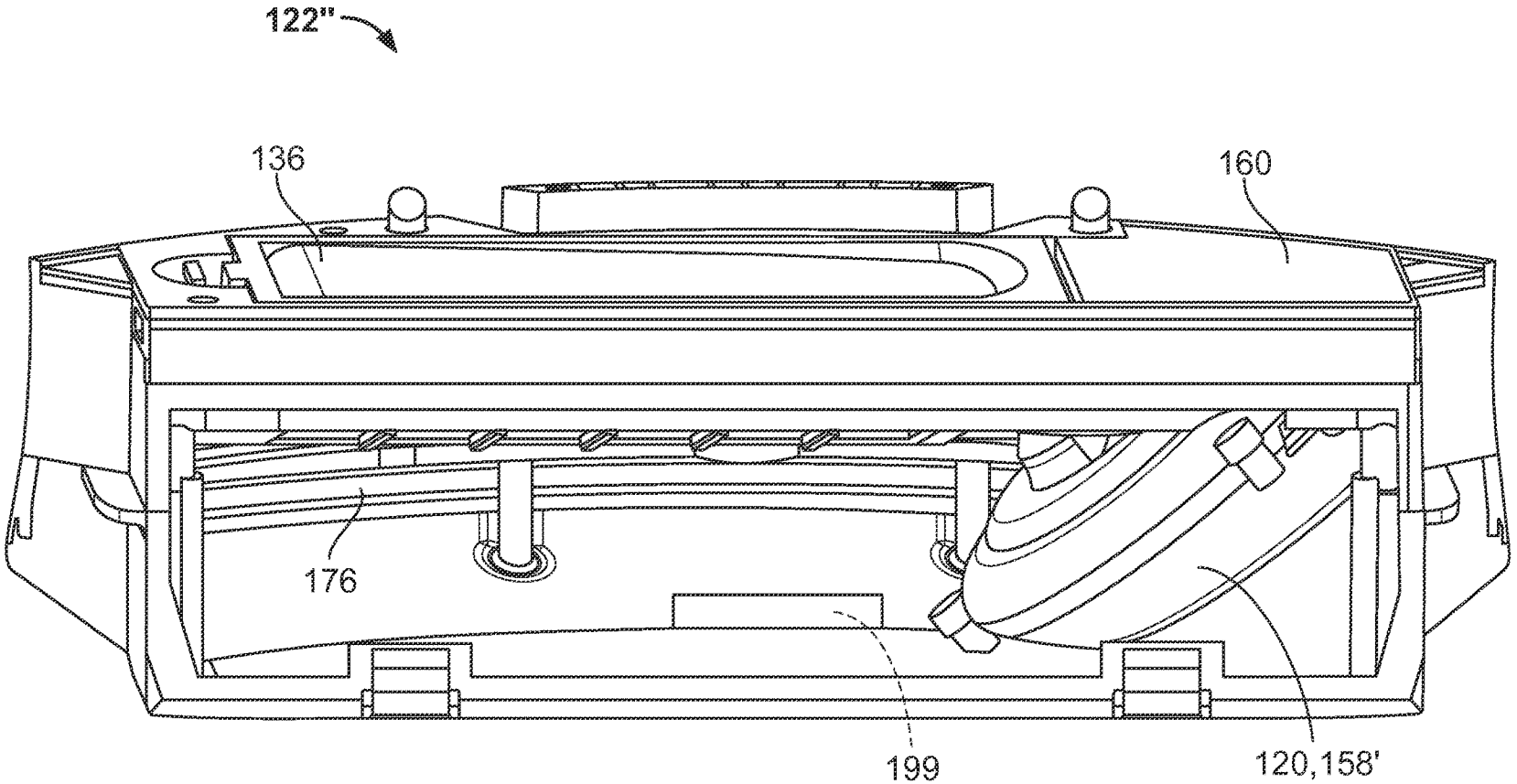
FIG. 17 is a front view of the second example cleaning bin illustrating the installation of the elongated sealing member.
Figure 18:
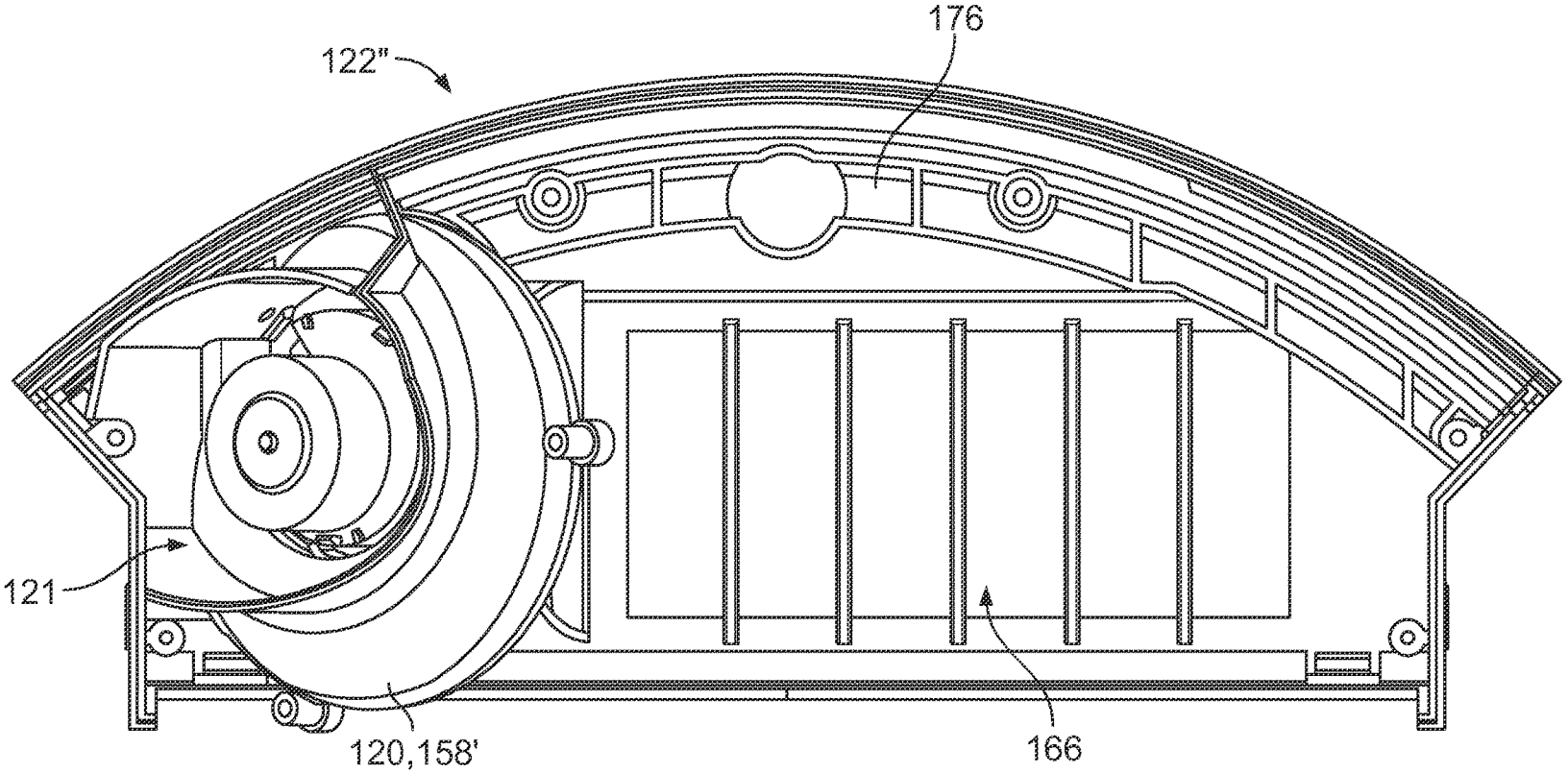
FIG. 18 is a top view of the second example cleaning bin illustrating the installation of the elongated sealing member.
Figure 19:
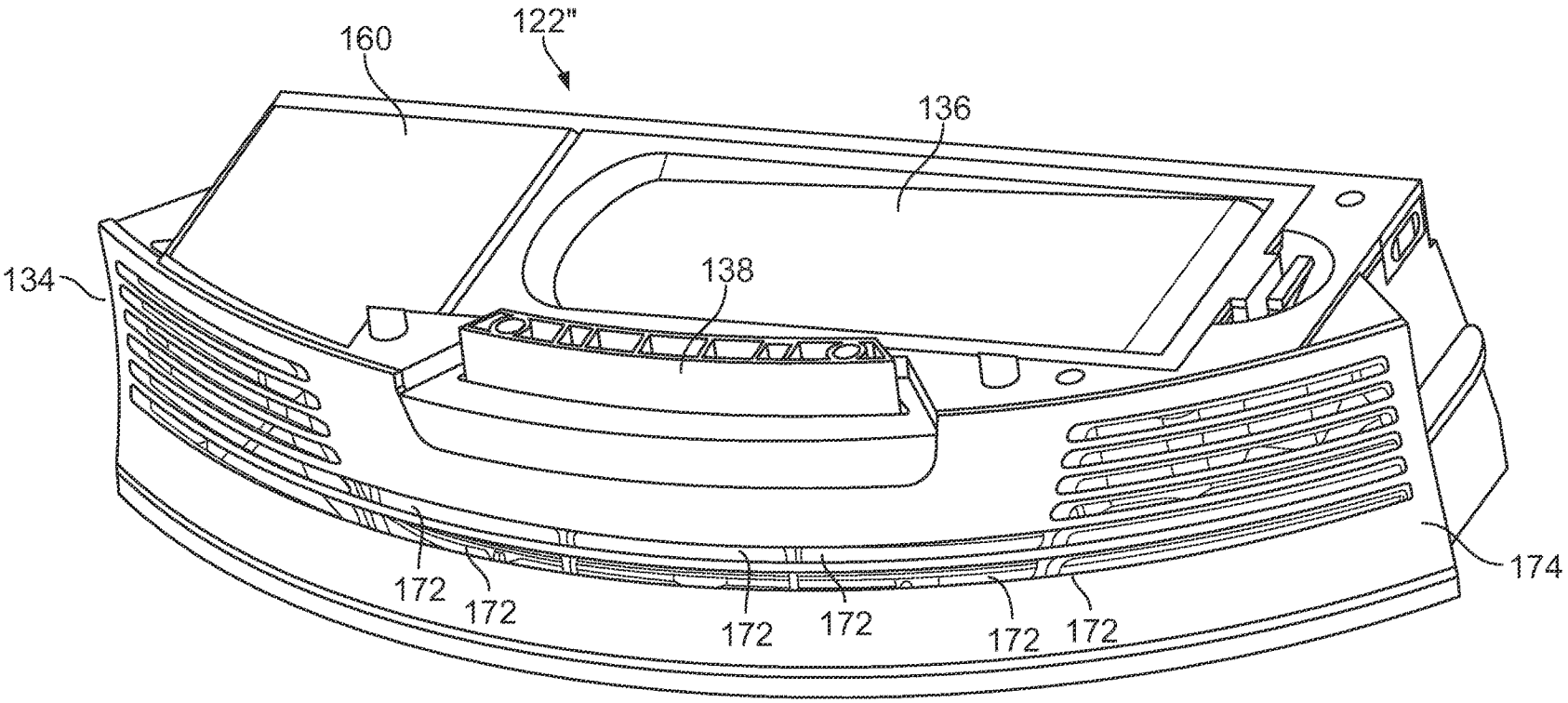
FIG. 19 is a rear perspective view of the second example cleaning bin.

In some embodiments, such as shown in FIGS. 13-15B, the cleaning bin 122 is configured such that the air intake 121 is oriented in a horizontal plane. In other embodiments, such as shown in FIGS. 16 and 18, the cleaning bin 122" is configured such that the robot vacuum 120 is tilted such that the air intake of the fan 195 is angled into the air passage 132. This creates a more direct path for the flow of air drawn through the filter 130 by the fan 195. This more direct path provides a more laminar flow, reducing or eliminating turbulence and eliminating back flow on the fan 195, thereby improving performance and efficiency relative to horizontally oriented implementations of the robot vacuum.

Figure 5A:
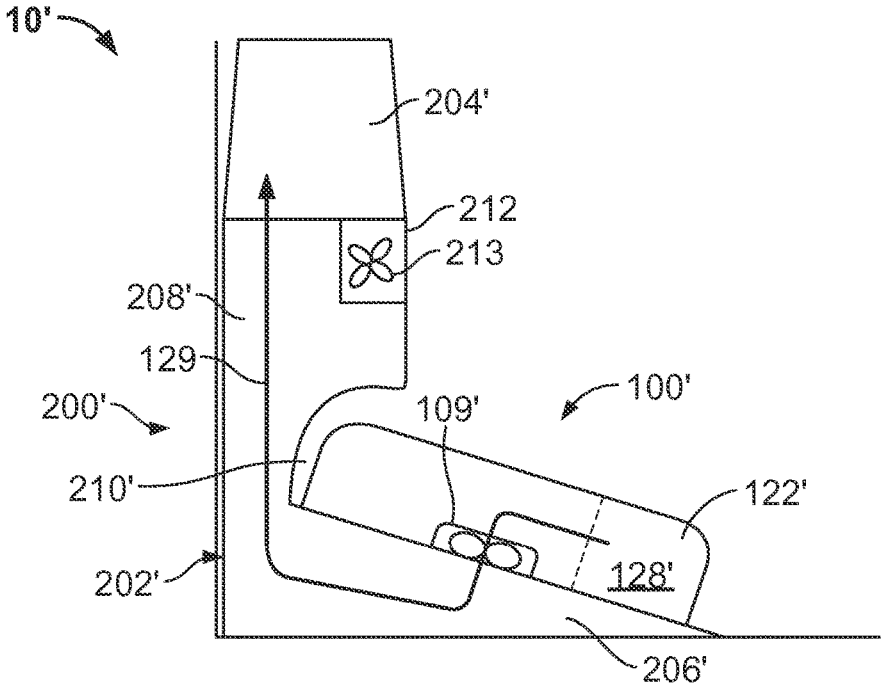
FIG. 5A is a schematic diagram of an example floor cleaning system illustrating the evacuation of air and debris from the cleaning bin of a cleaning robot.

As described in detail below, a vacuum sealing member (e.g., the vacuum sealing member 186 shown in FIGS. 10 and 14-16) may be installed in the air passage 132 to protect the robot vacuum 120 as air and debris are evacuated from the cleaning bin 122. The vacuum sealing member 186 remains in an open position as the robot 100 conducts cleaning operations because the air flowing through the air intake 121 of the robot vacuum 120 draws the vacuum sealing member 186 into an open position to allow the passage of air flowing through the cleaning bin 122. During evacuation, the flow of air is reversed (129) through the cleaning bin 122, as shown in FIG. 5A, and the vacuum sealing member 186 moves to an extended position, as shown in FIG. 15A, for blocking or substantially choking a reverse flow of air 129 through the robot vacuum 120. The reverse flow of air 129 would otherwise pull the fan 195 in a direction opposite the intake rotation direction and cause damage to the fan motor 119 configured to rotate the fan 195 in a single direction.

Filtered air exhausted from the robot vacuum 120 is directed through an exhaust port 134 (see FIGS. 2, 7, 13, and 19). In some examples, the exhaust port 134 includes a series of parallel slats angled upward, so as to direct airflow away from the floor surface. This design prevents exhaust air from blowing dust and other debris along the floor surface as the robot 100 executes a cleaning routine. The filter 130 is removable through a filter door 136. The cleaning bin 122 is removable from the shell 104 by a spring-loaded release mechanism 138.

Referring back to FIGS. 2 and 3, installed along the sidewall of the chassis 102, proximate the forward end 102*a* and ahead of the rollers 110, 112 in a forward drive direction, is a side brush 140 rotatable about an axis perpendicular to the floor surface. The side brush 140 allows the robot 100 to produce a wider coverage area for cleaning along the floor surface. In particular, the side brush 140 may flick debris from outside the area footprint of the robot 100 into the path of the centrally located cleaning head assembly.

Installed along either side of the chassis 102, bracketing a longitudinal axis of the roller housing 109, are independent drive wheels 142*a*, 142*b* that mobilize the robot 100 and provide two points of contact with the floor surface. The forward end 102*a* of the chassis 102 includes a non-driven, multi-directional caster wheel 144 which provides additional support for the robot 100 as a third point of contact with the floor surface.

A robot controller circuit 146 (depicted schematically) is carried by the chassis 102. The robot controller circuit 146 is configured (e.g., appropriately designed and programmed) to govern over various other components of the robot 100 (e.g., the rollers 110, 112, the side brush 140, and/or the drive wheels 142*a*, 142*b*). As one example, the robot controller circuit 146 may provide commands to operate the drive wheels 142*a*, 142*b* in unison to maneuver the robot 100 forward or backward. As another example, the robot controller circuit 146 may issue a command to operate drive wheel 142*a* in a forward direction and drive wheel 142*b* in a rearward direction to execute a clock-wise turn. Similarly, the robot controller circuit 146 may provide commands to initiate or cease operation of the rotating rollers 110, 112 or the side brush 140. For example, the robot controller circuit 146 may issue a command to deactivate or reverse bias the rollers 110, 112 if they become tangled. In some embodiments, the robot controller circuit 146 is designed to implement a suitable behavior-based-robotics scheme to issue commands that cause the robot 100 to navigate and clean a floor surface in an autonomous fashion. The robot controller circuit 146, as well as other components of the robot 100, may be powered by a battery 148 disposed on the chassis 102 forward of the cleaning head assembly 108.

The robot controller circuit 146 implements the behavior-based-robotics scheme based on feedback received from a plurality of sensors distributed about the robot 100 and communicatively coupled to the robot controller circuit 146. For instance, in this example, an array of proximity sensors 150 (depicted schematically) are installed along the periphery of the robot 110, including the front end bumper 106. The proximity sensors 150 are responsive to the presence of potential obstacles that may appear in front of or beside the robot 100 as the robot 100 moves in the forward drive direction. The robot 100 further includes an array of cliff sensors 152 installed along the forward end 102*a* of the chassis 102. The cliff sensors 152 are designed to detect a potential cliff, or flooring drop, forward of the robot 100 as the robot 100 moves in the forward drive direction. More specifically, the cliff sensors 152 are responsive to sudden changes in floor characteristics indicative of an edge or cliff of the floor surface (e.g., an edge of a stair). The robot 100 still further includes a bin detection system 154 (depicted schematically) for sensing an amount of debris present in the cleaning bin 122. As described in U.S. Patent Publication 2012/0291809 (the entirety of which is hereby incorporated by reference), the bin detection system 154 is configured to provide a bin-full signal to the robot controller circuit 146. In some embodiments, the bin detection system 154 includes a debris sensor (e.g., a debris sensor featuring at least one emitter and at least one detector) coupled to a microcontroller. The microcontroller can be configured (e.g., programmed) to determine the amount of debris in the cleaning bin 122 based on feedback from the debris sensor. In some examples, if the microcontroller determines that the cleaning bin 122 is nearly full (e.g., ninety or one-hundred percent full), the bin-full signal transmits from the microcontroller to the robot controller circuit 146. Upon receipt of the bin-full signal, the robot 100 navigates to the evacuation station 200 to empty debris from the cleaning bin 122. In some implementations, the robot 100 maps an operating environment during a cleaning run, keeping track of traversed areas and untraversed areas and stores a pose on the map at which the controller circuit 146 instructed the robot 100 to return to the evacuation station 200 for emptying. Once the cleaning bin 122 is evacuated, the robot 100 returns to the stored pose at which the cleaning routine was interrupted and resumes cleaning if the mission was not already complete prior to evacuation. In some implementations, the robot 100 includes at least on vision based sensor, such as a camera having a field of view optical axis oriented in the forward drive direction of the robot, for detecting features and landmarks in the operating environment and building a map using VSLAM technology.

Various other types of sensors, though not shown in the illustrated examples, may also be incorporated with the robot 100 without departing from the scope of the present disclosure. For example, a tactile sensor responsive to a collision of the bumper 106 and/or a brush-motor sensor responsive to motor current of the brush motor 118 may be incorporated in the robot 100.

A communications module 156 is mounted on the shell 104 of the robot 100. The communications module 156 is operable to receive signals projected from an emitter (e.g., the avoidance signal emitter 222*a* and/or the homing and alignment emitters 222*b* shown in FIGS. 21 and 22) of the evacuation station 200 and (optionally) an emitter of a navigation or virtual wall beacon. In some embodiments, the communications module 156 may include a conventional infrared ("IR") or optical detector including an omni-directional lens. However, any suitable arrangement of detector (s) and (optionally) emitter(s) can be used as long as the emitter of the evacuation station 200 is adapted to match the detector of the communications module 156. The communications module 156 is communicatively coupled to the robot controller circuit 146. Thus, in some embodiments, the robot controller circuit 146 may cause the robot 100 to navigate to and dock with the evacuation station 200 in response to the communications module 156 receiving a homing signal emitted by the evacuation station 200. Docking, confinement, home base, and homing technologies discussed in U.S. Pat. Nos. 7,196,487; 7,188,000, U.S. Patent Application Publication No. 20050156562, and U.S. Patent Application Publication No. 20140100693 (the entireties of which are hereby incorporated by reference) describe suitable homing-navigation and docking technologies.

Figure 5B:
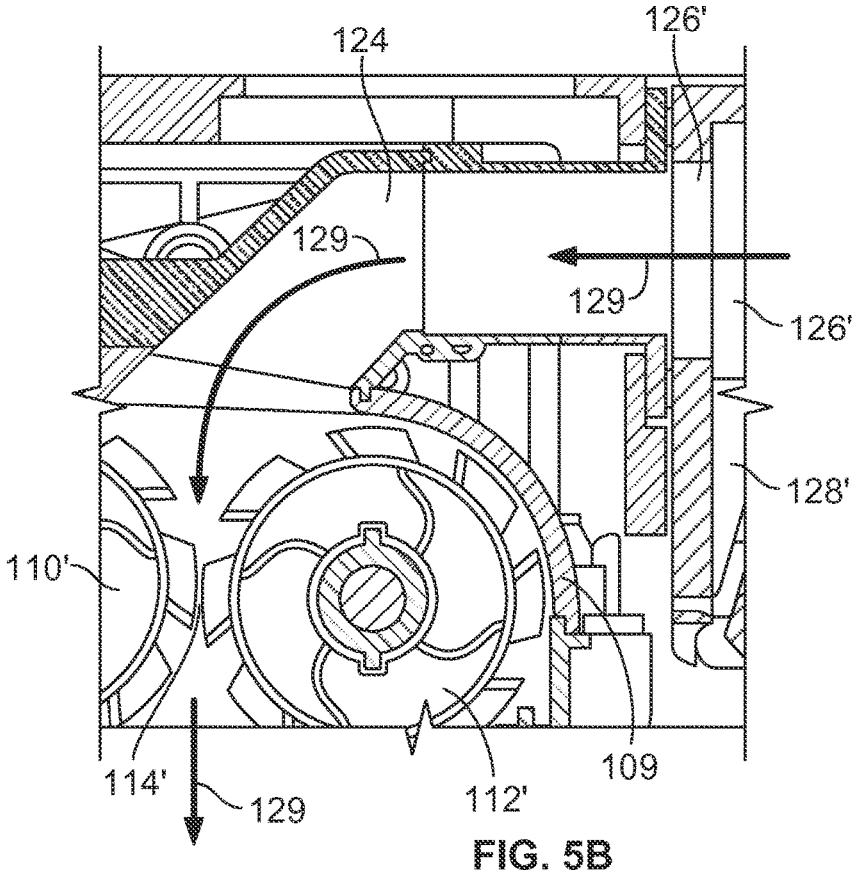
FIG. 5B is a schematic diagram illustrating the evacuation of air and debris through the cleaning head assembly of the cleaning robot.

FIGS. 5A and 5B illustrate the operation of an example cleaning system 10'. In particular, FIGS. 5A and 5B depict the evacuation of air and debris from the cleaning bin 122' of the robot 100' by the evacuation station 200'. Similar to the embodiment of depicted in FIG. 1, the robot 100' is docked with the evacuation station 200', resting on the platform 206' and received in the docking bay 210' of the base 208'. With the robot 100' in the docked position, the roller housing 109' is aligned with a suction opening (e.g., suction opening 216 shown in FIG. 21) defined in the platform 206' thereby forming a seal at the suction opening that limits or eliminates fluid losses and maximizes the pressure and speed of the reverse flow of air 129. As shown in FIG. 5A, an evacuation vacuum 212 is carried within the base 208' of the housing 202' and maintained in fluid communication with the suction opening in the platform 206' by internal ductwork (not shown). Thus, operation of the evacuation vacuum 212 draws air from the cleaning bin 122', through the roller housing 109', and into the evacuation station's housing 202' via the suction opening in the platform 206'. The evacuated air carries debris from the cleaning bin's collection cavity 128'. Air carrying the debris is routed by the internal ductwork (not shown) of the housing 202' to the debris canister 204'. As illustrated in FIG. 5B, airflow 129 and debris evacuated by the evacuation vacuum 212 passes through the opening 126' of the cleaning bin 122', through the plenum 124' into the roller housing 109', and through the gap 114' between the front 110' and rear 112' rollers. When the robot 100 docks with the evacuation station 200, the evacuation station 200 transmits a signal to the robot 100 to drive the roller motors in reverse during evacuation. This protects the roller motors from being back driven and potentially damaged.

Figure 6:
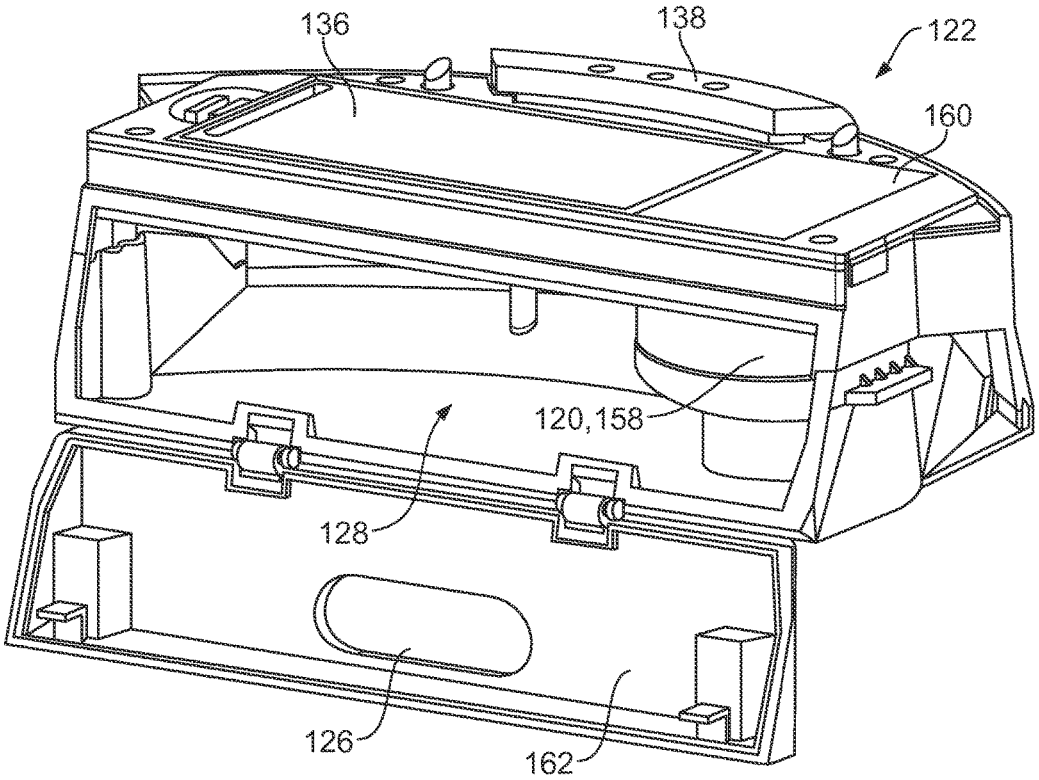
FIG. 6 is a perspective view of a first example cleaning bin of a cleaning robot.
Figure 7:
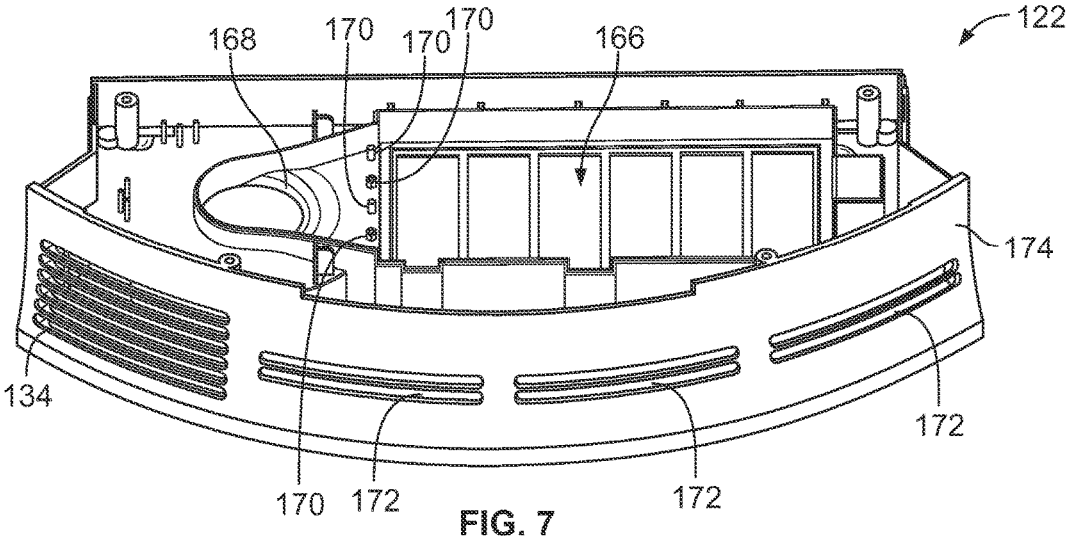
FIG. 7 is a perspective view of the frame of the first example cleaning bin.

Turning next to FIG. 6, the cleaning bin 122 carries the robot vacuum 120 in a vacuum housing 158 located beneath removable access panel 160 adjacent the filter door 136 along the top surface of the bin 122. A bin door 162 (depicted in an open position) of the cleaning bin 122 defines the opening 126 that leads to the debris collection cavity 128. As noted above, the opening 126 aligns with a plenum 124 that places the cleaning bin 122 in fluid communication with the roller housing 109 (see FIG. 4). As illustrated in FIG. 7, the cleaning bin 122 provides a rack 166 for holding the filter 130 and an adjacent port 168 for exposing the air intake 121 of the robot vacuum 120 to the air passage 132 (see FIG. 4). Mounting features 170 are provided between the rack 166 and the port 168 for securing a protective vacuum sealing member (e.g., the vacuum sealing member 186 shown in FIG. 10) to the cleaning bin 122. FIG. 7 also illustrates the exhaust port 134 and a plurality of suction vents 172 provided along the rear wall 174 of the cleaning bin 122. A lower portion of the exhaust port 134 not in fluid communication with the exhaust end of the fan 195 and the suction vents 172 are selectively blocked from fluid communication with the operating environment while the robot 100 is cleaning and opened during evacuation to allow for the movement of reverse airflow 129 from the operating environment through the cleaning bin 122.

Figure 8:
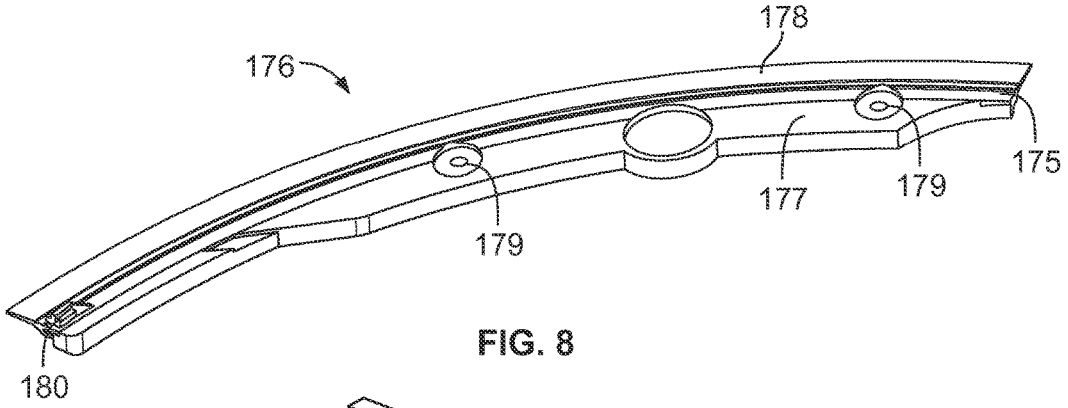
FIG. 8 is a perspective view of an elongated sealing member for sealing one or more suction vents of the first example cleaning bin.

In some embodiments, an elongated sealing member 176, shown in FIG. 8 (as well as FIGS. 12-14 and 16-18, is provided to seal the suction vents 172 as the robot 100 operates in a cleaning mode to inhibit the unintentional release of debris from the cleaning bin 122. As shown, the sealing member 176 is curved along its length to match the curvature of the cleaning bin's rear wall 174. In this example, the sealing member 176 includes a substantially rigid spine 177 and a substantially flexible and resilient flap 178 attached to the spine 177 (e.g., via a two-shot overmolding technique) at a hinged interface 175. The spine 177 includes mounting holes 179 and a hook member 180 for securing the sealing member 176 against the rear wall 174 of the cleaning bin 122 and the flap 178 hangs vertically across the suction vents 172 to block airflow therethrough during a robot cleaning mission. In some examples, the mounting holes 179 can be utilized in conjunction with suitable mechanical fasteners (e.g., mattel pins) and/or a suitable heat staking process to attach the spine 177 to the cleaning bin's rear wall 174. With the sealing member 176 appropriately installed, the flap 178 overhangs and engages the suction vents 172 to inhibit (if not prevent) egress of debris from the debris collection cavity 128. As noted above, operation of the evacuation vacuum 212 when the robot 100 is docked at the evacuation station 200 creates a suction force that pulls air and debris from cleaning bin 122. The suction force may also pull the hinged flap 178 away from the suction vents 172 to allow intake airflow from the operating environment to enter the cleaning bin 122. Thus, the flap 178 is movable from a closed position to an open position in response to reverse airflow 129 drawn by the evacuation vacuum 212 (see FIGS. 5A and 5B). In some embodiments, the spine 177 is manufactured from a material including Acrylonitrile Butadiene Styrene (ABS). In some embodiments, the flap 178 is manufactured from a material including a Styrene Ethylene Butylene Styrene Block Copolymer (SEBS) and/or a Thermoplastic Elastomer (TPE).

Figure 9:
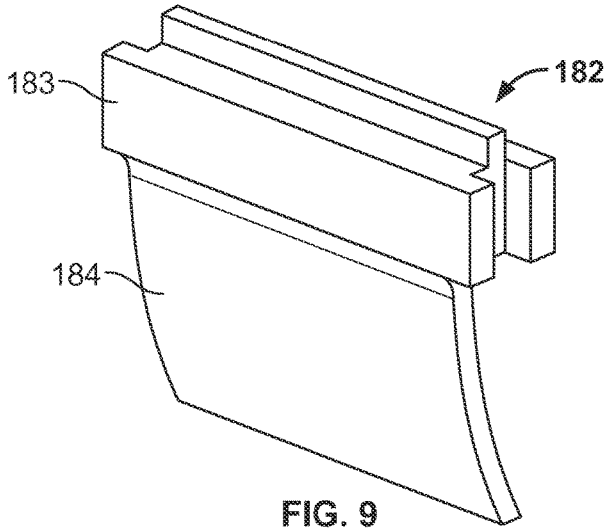
FIG. 9 is a perspective view of an auxiliary sealing member for sealing an area of the first example cleaning bin proximate an exhaust port.
Figure 11:
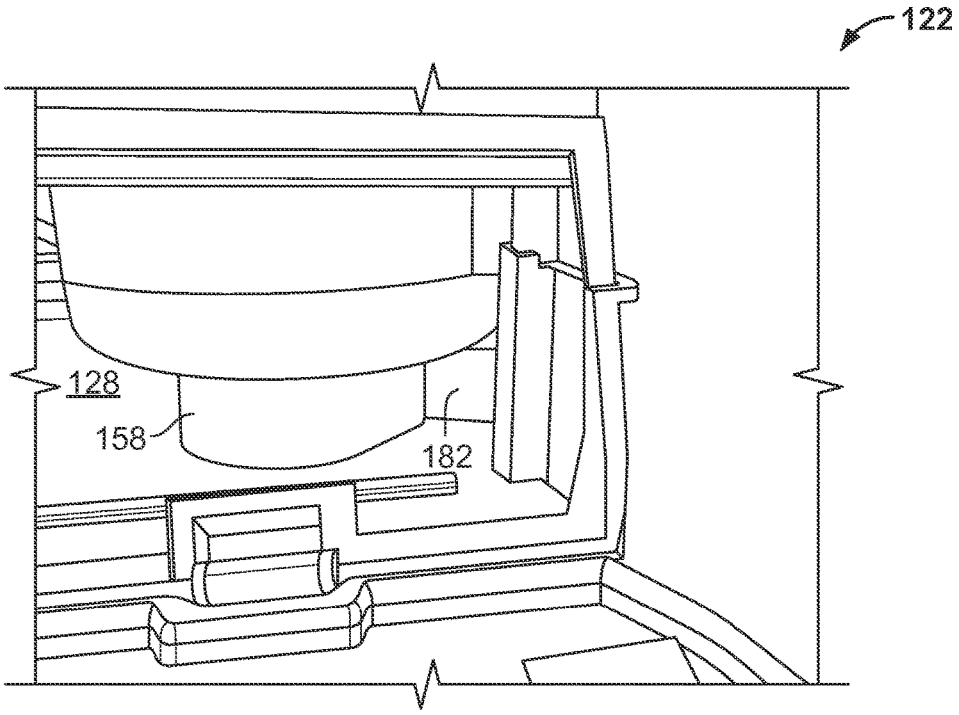
FIG. 11 is a perspective view of a portion of the first example cleaning bin depicting the installation location of the auxiliary sealing member.
Figure 12:
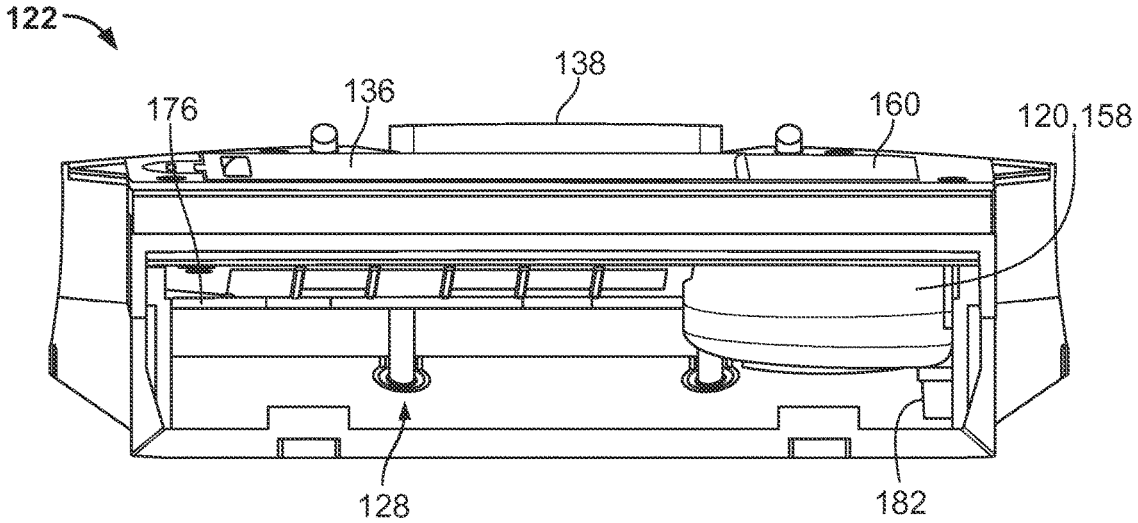
FIG. 12 is a front view of the first example cleaning bin illustrating the installation of the elongated sealing member and the auxiliary sealing member.
Figure 13:
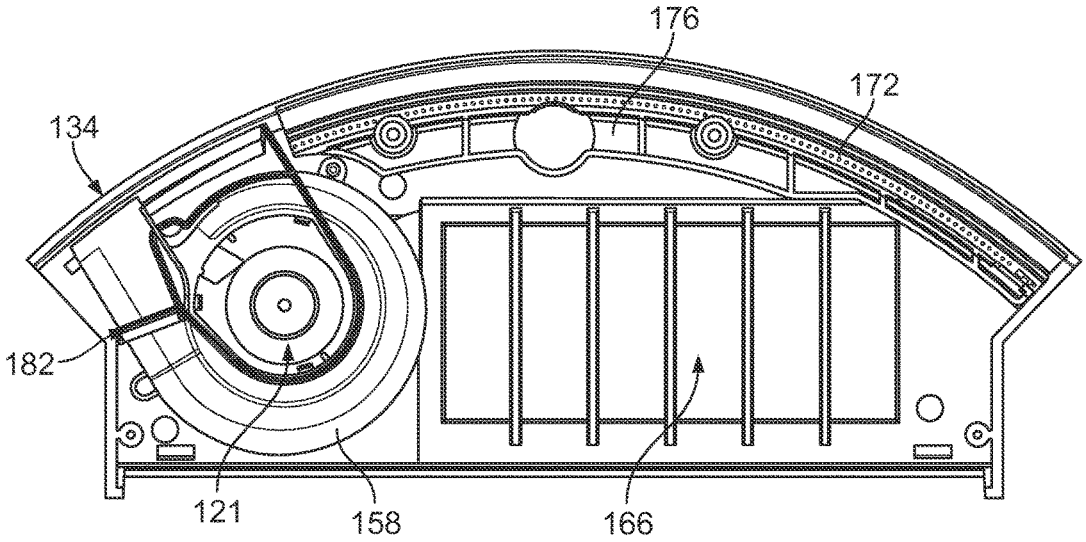
FIG. 13 is a top view of the first example cleaning bin illustrating the installation of the elongated sealing member and the auxiliary sealing member.

In some embodiments, an auxiliary sealing member 182, shown in FIGS. 9 and 11, is provided to seal along an interior side wall of the cleaning bin 122 and a lower portion of the exhaust port 134 not in fluid communication with the exhaust end of the fan 195 and located behind the vacuum housing 158 (see e.g., FIGS. 12 and 13). In this example, the sealing member 182 includes a relatively thick support structure 183 and a relatively thin, flexible and resilient flap 184 extending integrally from the support structure 183. With the support structure 183 mounted in place, the flap 184 is adjustable from a closed position to an open position in response to operation of the evacuation vacuum 212 (similar to the flap 178 shown in FIG. 8). By allowing reverse airflow 129 through the lower portion of the exhaust port 134, the auxiliary sealing member 182 ensures that any debris collected in the cleaning bin 122 around the bottom of the vacuum housing 158 is fully evacuated. In the absence of sufficient airflow around the bottom of the vacuum housing 158, dust and debris otherwise may remain trapped there during evacuation. The auxiliary sealing member 182 is lifted during evacuation to provide a laminar flow of air from the operating environment, through the lower portion of the exhaust port 134 and into the cleaning bin 122 at this constrained volume of the cleaning bin 122 not in the direct path of the reverse airflow 129 moving through the suction vents 172. While in the closed position during cleaning operations, the flap 184 can inhibit (if not prevent) the egress of dust and other debris into the area of the cleaning bin 122 around the lower portion of the exhaust port 134 where the dust and debris may be unintentionally released vented to the robot's operating environment. In some embodiments, the auxiliary sealing member 182 is manufactured using compression-molded rubber material (about 50 Shore A durometer).

Figure 10:
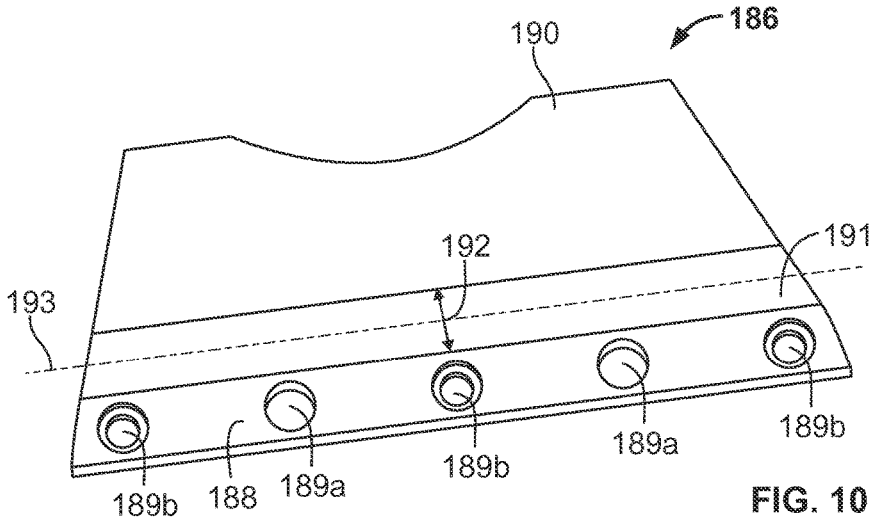
FIG. 10 is a perspective view of a vacuum sealing member for sealing an air passage leading to an air intake of a robot vacuum located in the first example cleaning bin.

As noted above, a vacuum sealing member 186, can be installed in the air passage 132 leading to the intake 121 of the robot vacuum 120. (See FIGS. 14-16) As shown in FIG. 10, the vacuum sealing member 186 includes a substantially rigid spine 188 and a substantially rigid flap 190. In some implementations, the distal edge of the flap 190 has a concave curvature for accommodating the circular opening of the port 168 leading to the air intake 121 of the robot vacuum 120 without blocking airflow through the robot vacuum 120 during a robot cleaning mission. For example, as depicted in FIGS. 14, 15B, and 16, the flap 190 is in a lowered position to allow air to flow through the air passage and the distal end of the flap abuts the port 168 (see FIG. 7) without blocking airflow through the air intake 121. In some implementations of a tilted robot vacuum 120, the vacuum housing 158' includes a recess or lip 187 that receives the distal end of the flap 190 in an open, or down, position. The recess 187 enables the flap 190 to lie flush with the wall of the air passage 132 and insures laminar air flow through the passage and into the air intake 121 of the fan 195.

The spine 188 and flap 190 are coupled to one another via a flexible and resilient base 191. In the example of FIG. 10, the spine 188 and flap 190 are each secured along a top surface of the base 191 (e.g., via a two-shot overmolding technique) and separated by a small gap 192. The gap 192 along the base acts as a joint that allows the spine 188 and flap 190 to pivot relative to one another along an axis 193 extending in a direction along the width of the base 191. In some embodiments, the spine 188 and/or the flap 190 may be manufactured from a material including Acrylonitrile Butadiene Styrene (ABS). In some embodiments, the resilient base 191 is manufactured from a material including a Styrene Ethylene Butylene Styrene Block Copolymer (SEBS) and/or a Thermoplastic Elastomer (TPE). The spine 188 includes mounting holes 189*a*, 189*b* for securing the vacuum sealing member 186 to the cleaning bin 122. For example, each of the mounting holes 189*a*, 189*b* may be designed to receive a location pin and/or a heat staking boss included in the mounting features 170.

FIGS. 15A and 15B illustrate the operation of the vacuum sealing member 186 as a one-way air flow valve that blocks reverse airflow 129 to the fan or as a constriction valve that substantially chokes reverse airflow 129 to the fan 195. As shown, with the spine 188 secured in place on via the mounting features 170 on the cleaning bin 122 (see FIG. 7), the vacuum sealing member 186 provides a one-way air flow valve in the air passage 132. The vacuum sealing member 186 is positioned between the robot vacuum 120 and the filter 130 so as to selectively block/constrict the flow of air in the portion of the air passage 132 therebetween. In an open position, the sealing member 186 lies substantially in a horizontal plane with the top of the filter 130 and air intake 121. In a closed position, the flap 190 folds upward and extends to the top wall 133 of the air passage 132. In a closed position, the sealing member 186 therefore substantially isolates the robot vacuum 120 from the filter 130 by completely blocking or substantially restricting the air passage 132. In particular, the vacuum sealing member 186 is oriented in the air passage 132 such that suction force created by the evacuation vacuum 212 pulls the vacuum sealing member 186 to a closed position via an upward pivoting motion 194 of the flap 190 relative to the spine 188. As shown in FIG. 15A, when the vacuum sealing member 186 is in the closed position, the flap 190 engages the surrounding walls of the air passage 132 to substantially seal the fan 195 at the intake 121 of the robot vacuum 120 from the interior of the cleaning bin 122. In this way, the robot vacuum motor powering the fan 195 is protected against back-EMF that may be generated if suction force during evacuation of the cleaning bin 122 were allowed to drive the fan 195 against the motor in reverse. Further, the fan 195 is protected against the risk of damage that may occur if the fan 195 is allowed to spin at abnormally high speeds as a result of the suction force during evacuation (e.g., such high speed rotation could cause the fan to "spin weld" in place as a result of frictional heat). When the evacuation suction force is removed, the vacuum sealing member 186 moves to an open position via a downward pivoting motion 196 of the flap 190. Thus, the one-way valve remains in an open position to avoid air flow interference as the robot 100 conducts cleaning operations.

Figure 21:
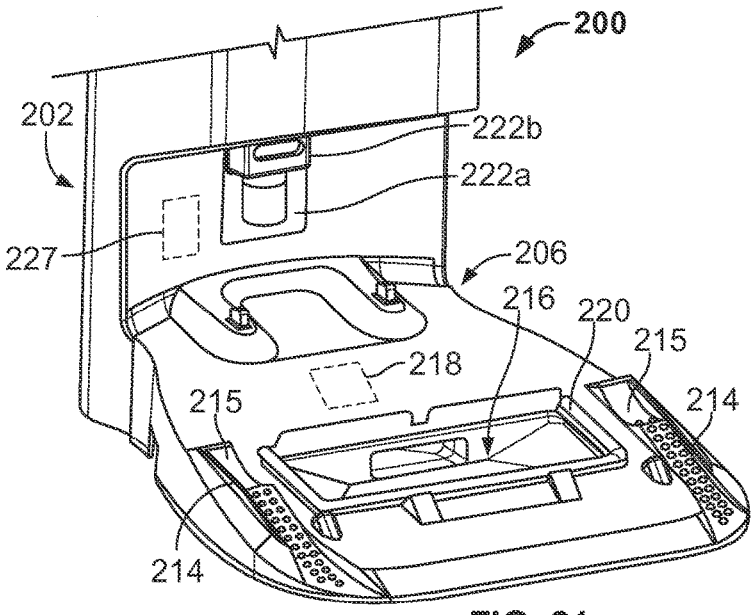
FIG. 21 is a perspective view of a platform of the evacuation station.

Turning next to FIG. 21, the platform 206 of the evacuation station 200 includes parallel wheel tracks 214, a suction opening 216, and a robot-compatibility sensor 218. The wheel tracks 214 are designed to receive the robot's drive wheels 142*a*, 142*b* to guide the robot 100 onto the platform 206 in proper alignment with the suction opening 216. Each of the wheel tracks 214 includes depressed wheel well 215 that holds the drive wheels 142*a*, 142*b* in place to prevent the robot 100 from unintentionally sliding down the inclined platform 206 once docked. In the illustrated example, the wheel tracks 214 are provided with a suitable tread pattern that allow the robot's drive wheels 142*a*, 142*b* to traverse the inclined platform 206 without significant slippage. In contrast, the wheel wells 215 are substantially smooth to induce slippage of the drive wheels 142*a*, 142*b* that may inhibit the robot 100 from unintentionally moving forward into a collision with the base 208. However, in some embodiments, the rear lip of the wheel wells 215 may include at least some traction features (e.g., treads) that allow the drive wheels 142*a*, 142*b* to "climb" out of the wheel wells 215 when the robot detaches from the evacuation station 200.

Figure 20:
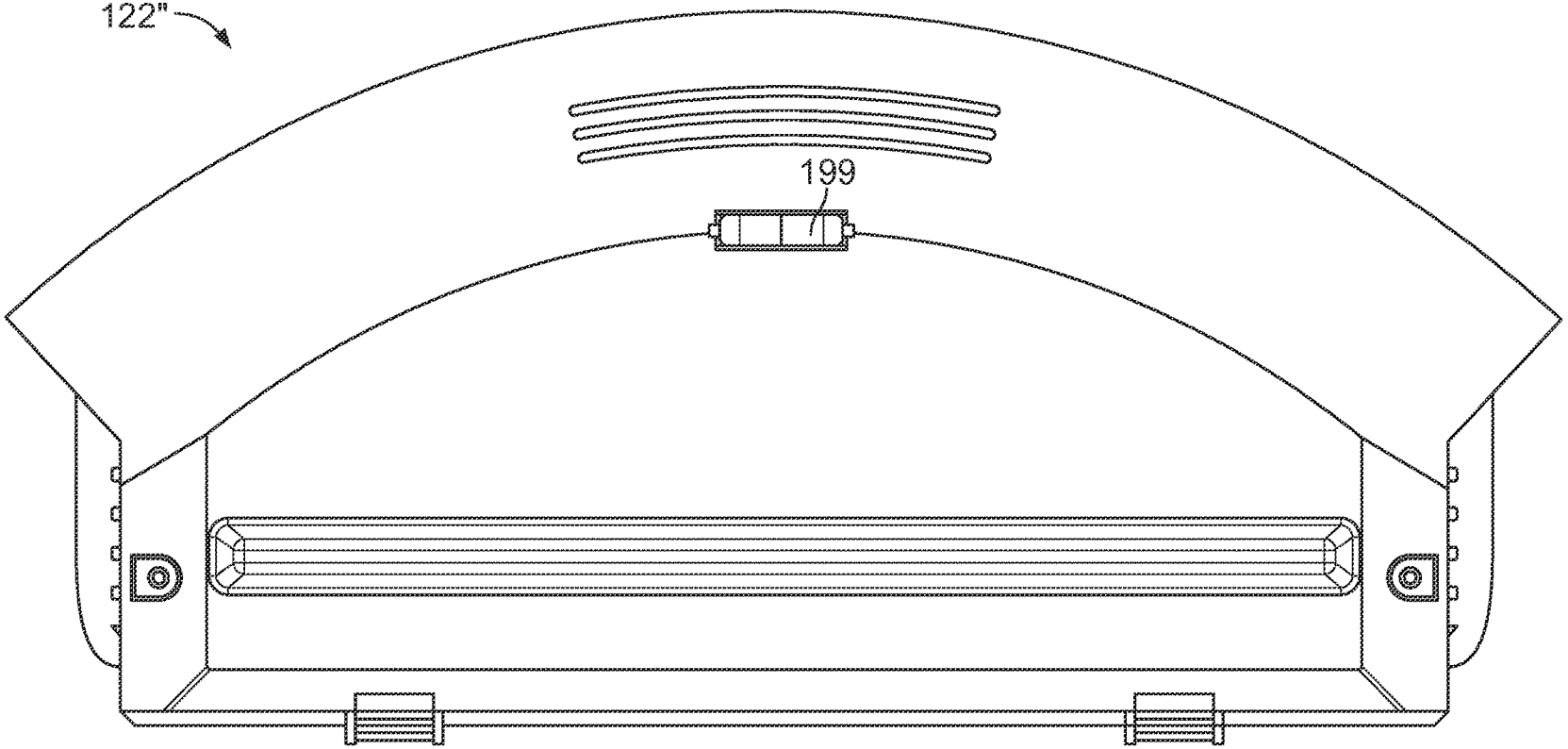
FIG. 20 is a bottom view of the second example cleaning bin.

In some implementations, such as shown in FIG. 20, the cleaning bin 122 includes a passive roller 199 along a bottom surface that engages the inclined platform while the robot 100 docks with the evacuation station. The passive roller 199 prevents the bottom of the cleaning bin 122 from scraping along the platform 206 as the robot 100 pitches upward to climb the inclined platform 206. The suction opening 216 includes a perimeter seal 220 that engages the robot's roller housing 109 to provide a substantially sealed air-flow interface between the robot 100 and the evacuation station 200. This sealed air-flow interface effectively places the evacuation vacuum 212 in fluid communication with the robot's cleaning bin 122. The robot-compatibility sensor 218 (depicted schematically) is designed to detect whether the robot 100 is compatible for use with the evacuation station 200. As one example, the robot-compatibility sensor 218 may include an inductance sensor responsive to the presence of a metallic plate 197 (see FIG. 3) installed on the robot chassis 102. In this example, a manufacturer, retailer or service personnel may install the metallic plate 197 on the chassis 102 if the robot 100 is suitably equipped for operation with the evacuation station 200 (e.g., if the robot 100 is equipped with one or more of the vents and/or sealing members described above to facilitate evacuation of the cleaning bin 122). In another example, a robot 100 compatible with the evacuation station is equipped with a receiver that recognizes a uniquely encoded docking signal emitted by the evacuation station 200. An incompatible robot will not recognize the encoded docking signal and will not align with the evacuation station 200 platform 206 for docking.

Figure 22:
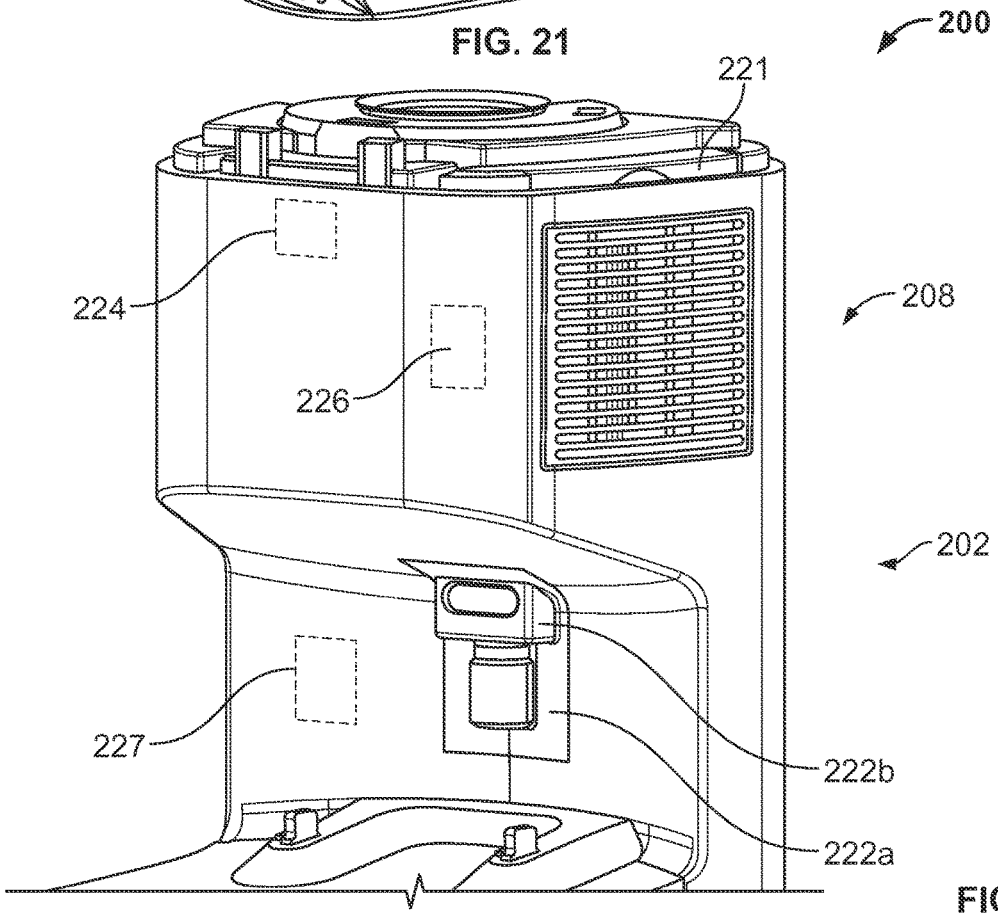
FIG. 22 is a perspective view of a frame of the evacuation station.

The housing 202 of the evacuation station, including the platform 206 and the base 208, includes internal ductwork (not shown) for routing air and debris evacuated from the robot's cleaning bin 122 to the evacuation station debris canister 204. The base 208 also houses the evacuation vacuum 212 (see FIG. 5A) and a vacuum filter 221 (e.g., a HEPA filter) located at the exhaust side of the evacuation vacuum 212. Referring now to FIG. 22, the base 208 of the evacuation station 200 carries an avoidance signal emitter 222*a*, homing and alignment emitters 222*b*, a canister sensor 224, a motor sensor 226, and a wireless communications system 227. As noted above, the homing and alignment emitters 222*b* are operable to emit left and right homing signals (e.g., optical, IR or RF signals) detectable by the communications module 156 mounted on the shell 104 of the robot 100 (see FIG. 2). In some examples, the robot 100 may search for and detect the homing signals in response a determination that the cleaning bin 122 is full. Once the homing signals are detected, the robot 100 aligns itself with the evacuation station 200 and docks itself on the platform 206. The canister sensor 224 (depicted schematically) is responsive to the attachment and detachment of the debris canister 204 from the base 208. For example, the canister sensor 224 may include a contact switch (e.g., a magnetic reed switch or a reed relay) actuated by attachment of the debris canister 204 to the base 208. In other examples, the base 208 may include optical sensors configured to detect when a portion of the internal ductwork included in the base 208 is mated with a portion of the internal ductwork included in the canister 204. In yet other examples, the base 208 and canister 204 mate at an electrical connector. The mechanical, optical or electrical connections signal the presence of the canister 204 so that evacuation may commence. If no canister 204 presence is detected by the canister sensor 224, the evacuation vacuum 212 will not operate. The motor sensor 226 (depicted schematically) is responsive to operation of the evacuation vacuum 212. For example, the motor sensor 226 may be responsive to the motor current of the evacuation vacuum 212. A signal from the motor sensor 226 can be used to determine whether the vacuum filter 221 is in need of replacement. For example, and increased motor current may indicate that the vacuum filter 221 is clogged and should be cleaned or replaced. In response to such a determination, a visual indication of the vacuum filter's status can be provided to the user. As described in U.S. Patent Publication 2014/0207282 (the entirety of which is hereby incorporated by reference), the wireless communications system 227 may facilitate the communication of information describing a status of the evacuation station 200 over a suitable wireless network (e.g., a wireless local area network) with one or more mobile devices (e.g., mobile device 300 shown in FIGS. 24A-24D).

Turning back to FIG. 1, the evacuation station 200 still further includes a canister detection system 228 (depicted schematically) for sensing an amount of debris present in the debris canister 204. Similar to the bin detection system 154, the canister detection system 228 can be designed to generate a canister-full signal. The canister-full signal may indicate a fullness state of the debris canister 204. In some examples, the fullness state can be expressed in terms of a percentage of the debris canister 204 that is determined to be filled with debris. In some embodiments, the canister detection system 228 can include a debris sensor coupled to a microcontroller. The microcontroller can be configured (e.g., programmed) to determine the amount of debris in the debris canister 204 based on feedback from the debris sensor. The debris sensor may be an ultrasonic sensor placed in a sidewall of the canister for detecting volume of debris. In other examples, the debris sensor may be an optical sensor placed in the side or top of the canister 204 for detecting the presence or amount of debris. In yet other examples, the debris sensor is a mechanical sensor placed with the canister 204 for sensing a change in air flow impedance through the debris canister 204, or a change in pressure air flow or air speed through the debris canister 204. In another example, the debris sensor detects a change in motor current of the evacuation vacuum 212, the motor current increasing as the canister 204 fills and airflow is increasingly impeded by the accumulation of debris. All of these measured properties are altered by the presence of debris filling the canister 204. In another example, the canister 204 may contain a mechanical switch triggered by the accumulation of a maximum volume of debris. In yet another example, the evacuation station 200 tracks the number of evacuations from the cleaning bin 122 and calculates, based on maximum bin capacity (or an average debris volume of the bin), the number of possible evacuations remaining until the evacuation station debris canister 204 reaches maximum fullness. In some examples, the canister 204 contain a debris collection bag (not shown) therein hanging above the evacuation vacuum 212, which draws air down and through the collection bag.

Figure 23:
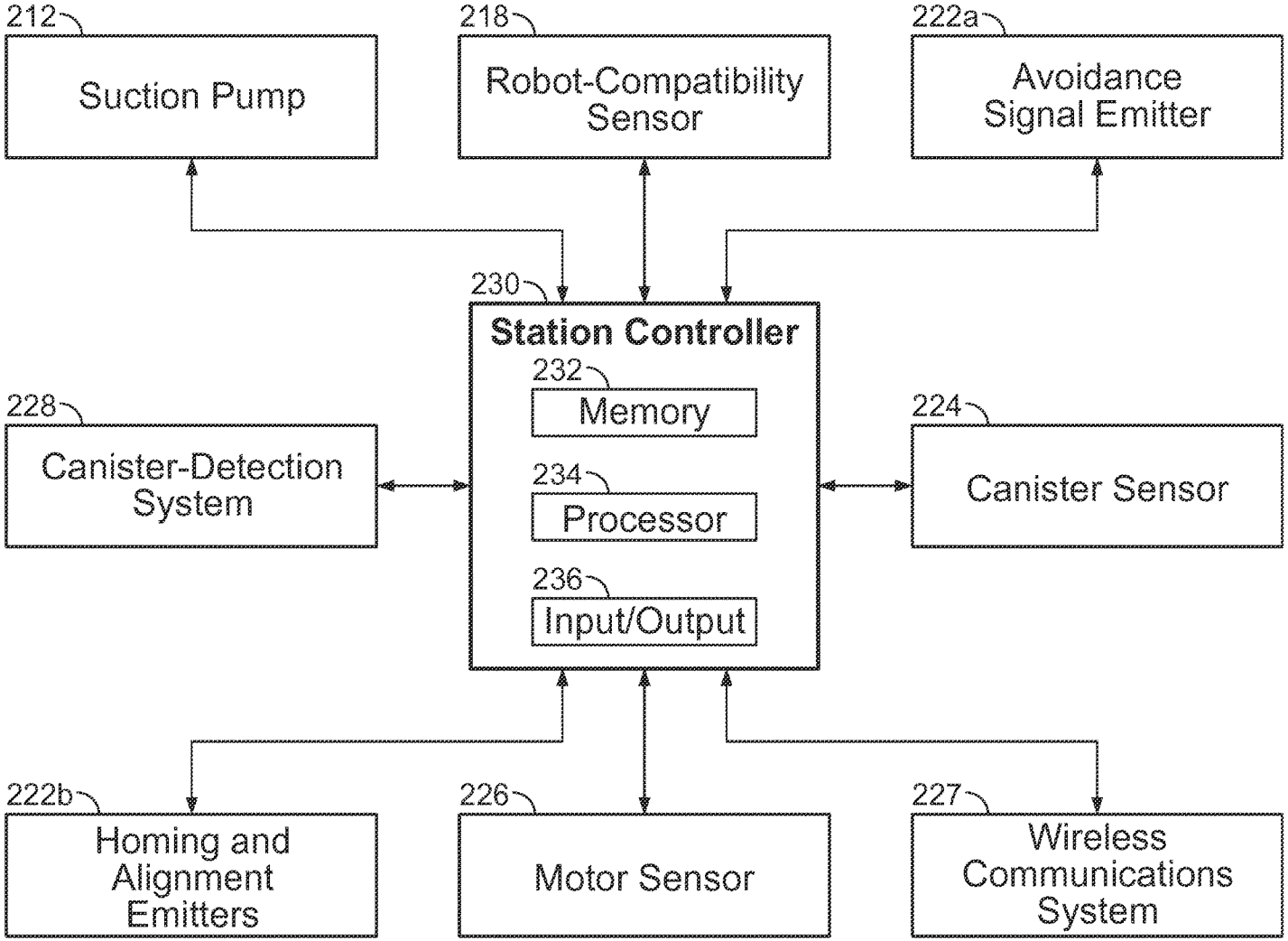
FIG. 23 is a diagram illustrating an example control architecture for operating the evacuation station.

As shown in FIG. 23, the robot-compatibility sensor 218, the canister sensor 224, the motor sensor 226, and the canister detection system 228 are communicatively coupled to a station controller circuit 230. The station controller circuit 230 is configured (e.g., appropriately designed and programmed) to operate the evacuation station 200 based on feedback from these respective devices. The station controller circuit 230 includes a memory unit 232 that holds data and instructions for processing by a processor 234. The processor 234 receives program instructions and feedback data from the memory unit 232, executes logical operations called for by the program instructions, and generates command signals for operating various components of the evacuation station 200 (e.g., the evacuation vacuum 212, the avoidance signal emitter 222*a*, the home and alignment emitters 222*b*, and the wireless communications system 227). An input/output unit 236 transmits the command signals and receives feedback from the various illustrated components.

In some examples, the station controller circuit 230 is configured to initiate operation of the evacuation vacuum 212 in response to a signal received from the robot-compatibility sensor 218. Further, in some examples, the station controller circuit 230 is configured to cease or prevent operation of the evacuation vacuum 212 in response to a signal received from the canister detection system 228 indicating that the debris canister 204 is nearly or completely full. Further still, in some examples, the station controller circuit 230 is configured to cease or prevent operation of the evacuation vacuum 212 in response to a signal received from the motor sensor 226 indicating a motor current of the evacuation vacuum 212. The station controller circuit 230 may deduce an operational state of the vacuum filter 221 based on the motor-current signal. As noted above, if the signal indicates an abnormally high motor current, the station controller circuit 230 may determine that the vacuum filter 221 is dirty and needs to be cleaned or replaced before the evacuation vacuum 212 can be reactivated.

In some examples, the station controller circuit 230 is configured to operate the wireless communications system 227 to communicate information describing a status of the evacuation station 200 to a suitable mobile device (e.g., the mobile device 300 shown in FIGS. 24A-24D) based on feedback signals from the robot-compatibility sensor 218, the canister sensor 224, the motor sensor 226, and/or the canister detection system 228. In some examples, a suitable mobile device may be any type of mobile computing device (e.g., mobile phone, smart phone, PDA, tablet computer, wrist-worn computing device, or other portable device) that includes among other components, one or more processors, computer readable media that store software applications, input devices (e.g., keyboards, touch screens, microphones, and the like), output devices (e.g., display screens, speakers, and the like), and communications interfaces.

Figure 24A:
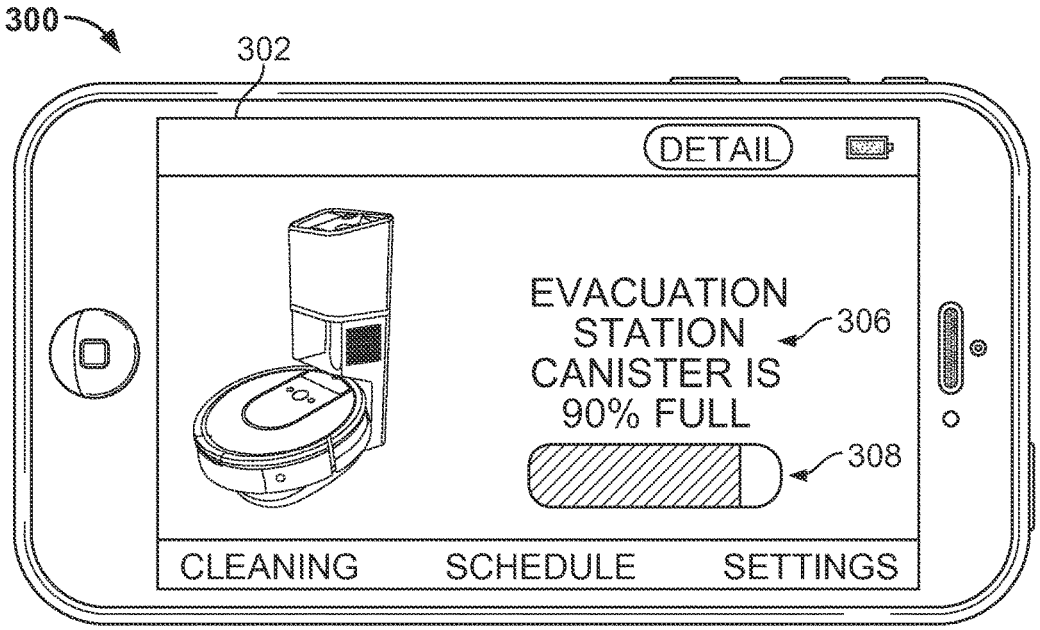
FIGS. 24A-24D are plan views of a mobile device executing a software application displaying information related to operation of the evacuation station.
Figure 24B:
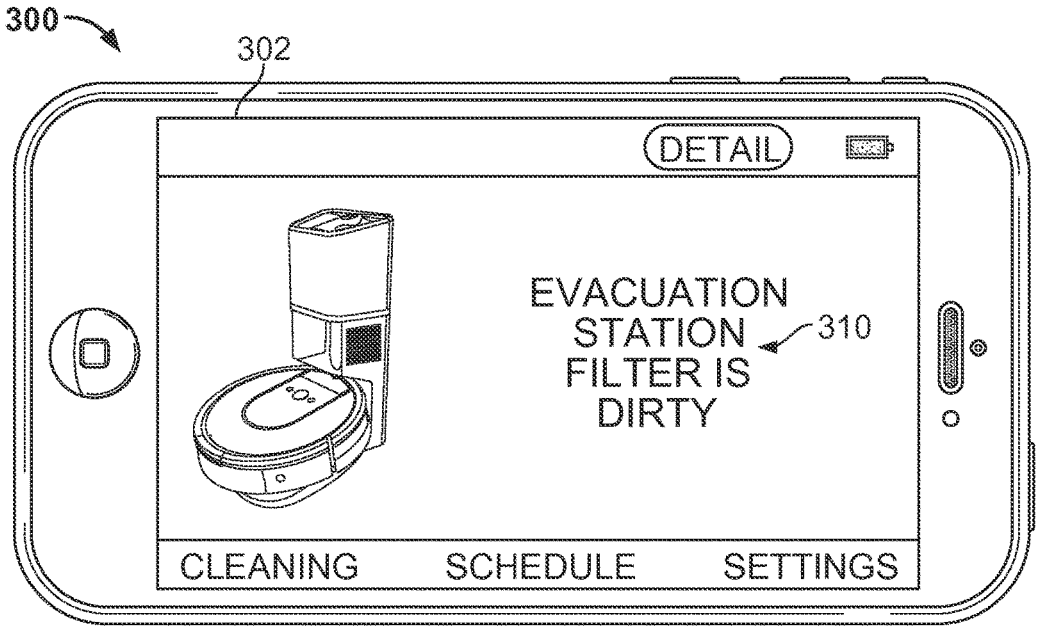
Figure 24C:
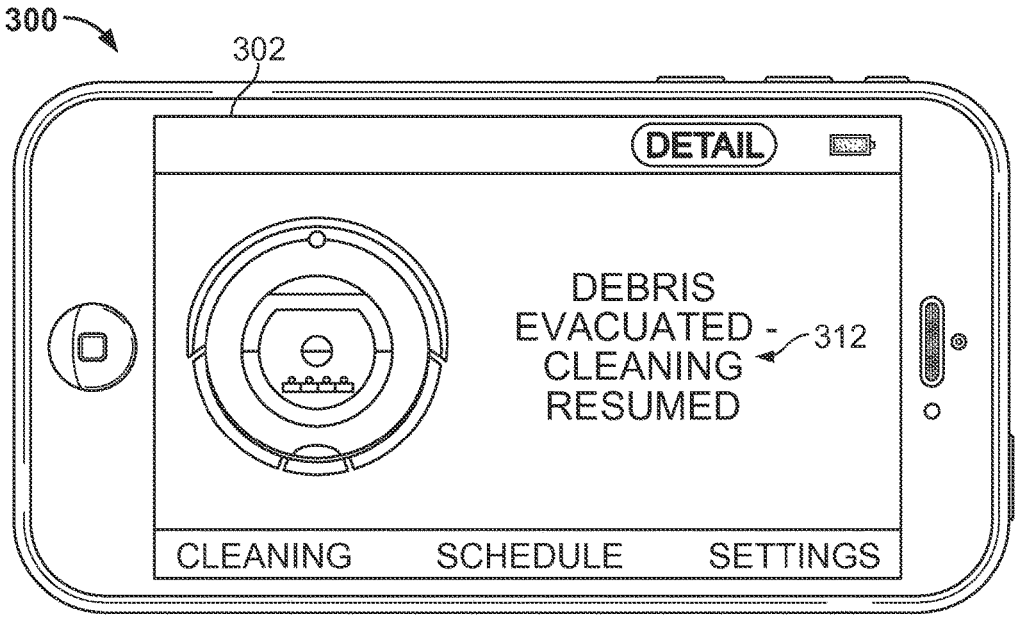
Figure 24D:
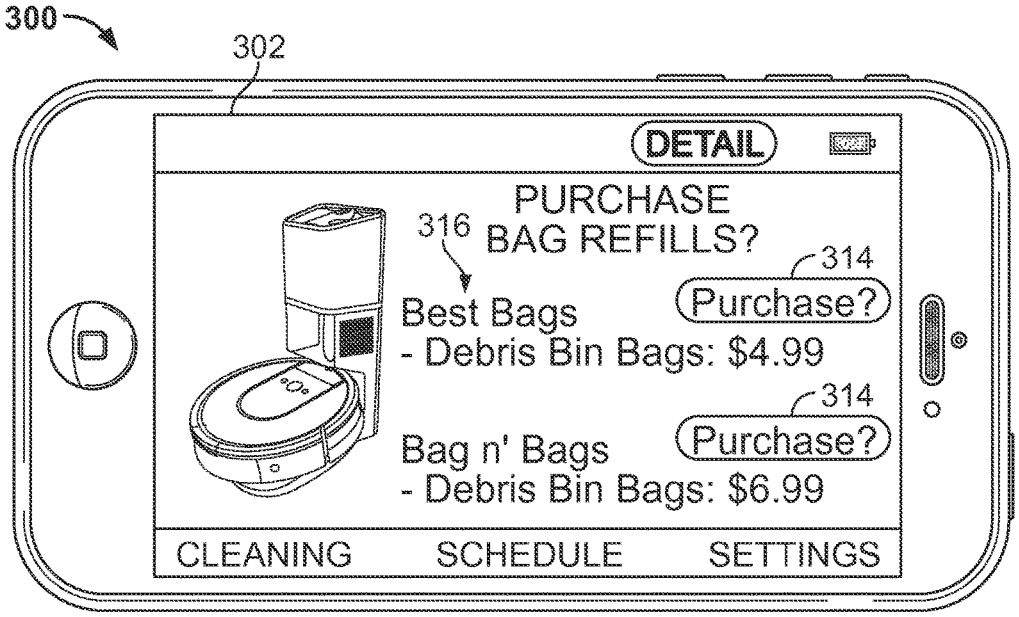

In the example depicted at FIGS. 24A-24D, the mobile device 300 is provided in the form of a smart phone. As shown, the mobile device 300 is operable to execute a software application that displays status information received from the station controller circuit 230 (see FIG. 23) on the display screen 302. In FIG. 24A, an indication of the fullness state of the debris canister 204 is presented on the display screen 302 in terms of a percentage of the canister that is determined via the canister detection system 228 to be filled with debris. In this example, the indication is provided on the display screen 302 by both textual 306 and graphical 308 user-interface elements. Similarly, in FIG. 24B, an indication of the operational state of the vacuum filter 221 is presented on the display screen 302 in the form of a textual user-interface element 310. In the foregoing examples, the software application executed by the mobile device 300 is shown and described as providing alert-type indications to a user that maintenance of the evacuation station 200 is required. However, in some examples, the software application may be configured to provide status updates at predetermined time intervals. Further, in some examples, the station controller circuit 230 may detect when the mobile device 300 enters the network, and in response to this detection, provide a status update of one or more components to be presented on the display screen 302 via the software application. In FIG. 24C, the display screen 302 provides a textual user-interface element 312 indicative of the completed evacuation status of the robot 100 and notifying the user that cleaning has resumed. In FIG. 24D, the display screen 302 provides one or more "one click" selection options 314 for ordering a new debris bag for an embodiment of the evacuation station debris canister 204 having a disposable bag therein for collecting debris. Further, in the illustrated example, textual user-interface elements 316 present one or more pricing options represented along with the name of a corresponding online vendor. Further still, the software application may be operable to provide various other types of user-interface screens and elements that allow a user to control the evacuation station 200 or the robot 100, such as shown and described in U.S. Patent Publication 2014/0207282.

While a number of examples have been described for illustration purposes, the foregoing description is not intended to limit the scope of the invention, which is defined by the scope of the appended claims. There are and will be other examples and modifications within the scope of the following claims.

Further, the use of terminology such as "front," "back," "top," "bottom," "over," "above," and "below" throughout the specification and claims is for describing the relative positions of various components of the disclosed system(s), apparatus and other elements described herein. Similarly, the use of any horizontal or vertical terms to describe elements is for describing relative orientations of the various components of the system and other elements described herein. Unless otherwise stated explicitly, the use of such terminology does not imply a particular position or orientation of the system or any other components relative to the direction of the Earth gravitational force, or the Earth ground surface, or other particular position or orientation that the system(s), apparatus other elements may be placed in during operation, manufacturing, and transportation.

What is claimed is:

1. A robotic floor cleaning system, comprising:

a mobile floor cleaning robot comprising a chassis with at least one drive wheel operable to propel the robot across a floor surface;

a cleaning bin disposed within the robot and arranged to receive debris ingested by the robot during cleaning; and a robot vacuum comprising a motor and a fan connected to the motor and configured to generate a flow of air to pull debris into the cleaning bin from an opening on an underside of the robot; and an evacuation station configured to evacuate debris from the cleaning bin of the robot, the evacuation station comprising a housing defining a platform arranged to receive the robot in a position in which the opening on the underside of the robot aligns with a suction opening defined in the platform; and an evacuation vacuum in fluid communication with the suction opening and operable to draw air into the housing through the suction opening, wherein the robot further comprises a one-way air flow valve disposed within the robot and configured to automatically close in response to operation of the evacuation vacuum, and wherein the air flow valve is disposed in an air passage connecting the robot vacuum to an interior of the cleaning bin.

2. The robotic floor cleaning system of claim 1, wherein the air flow valve is located within the robot such that, with the air flow valve in a closed position, the fan is substantially sealed from the interior of the cleaning bin.

3. The robotic floor cleaning system of claim 1, wherein operation of the evacuation vacuum causes a reverse airflow to pass through the cleaning bin, carrying dirt and debris from the cleaning bin, through the suction opening, and into the housing of the evacuation station.

4. The robotic floor cleaning system of claim 1, wherein the cleaning bin comprises:

at least one opening along a wall of the cleaning bin; and a sealing member mounted to the wall of the cleaning bin in alignment with the at least one opening.

5. The robotic floor cleaning system of claim 4, wherein the at least one opening comprises one or more suction vents located along a rear wall of the cleaning bin.

6. The robotic floor cleaning system of claim 4, wherein the at least one opening comprises an exhaust port located along a side wall of the cleaning bin proximate the robot vacuum.

7. The robotic floor cleaning system of claim 4, wherein the sealing member comprises a flexible and resilient flap adjustable from a closed position to an open position in response to operation of the evacuation vacuum.

8. The robotic floor cleaning system of claim 4, wherein the sealing member comprises an elastomeric material.

9. The robotic floor cleaning system of claim 1, wherein the robot further comprises a cleaning head assembly disposed in the opening on the underside of the robot, the cleaning head assembly comprising a pair of rollers positioned adjacent one another to form a gap therebetween, and wherein operation of the evacuation vacuum causes a reverse airflow to pass from the cleaning bin to pass through the gap between the rollers.

10. The robotic floor cleaning system of claim 1, wherein the evacuation station further comprises a robot-compatibility sensor responsive to a metallic plate located proximate a base of the cleaning bin.

11. The robotic floor cleaning system of claim 10, wherein the robot-compatibility sensor comprises an inductive sensing component.

12. The robotic floor cleaning system of claim 1, wherein the evacuation station further comprises:

a debris canister detachably coupled to the housing for receiving debris carried by air drawn into the housing by the evacuation vacuum through the suction opening, and a canister sensor responsive to attachment and detachment of the debris canister to and from the housing.

13. The robotic floor cleaning system of claim 12, wherein the evacuation station further comprises:

at least one debris sensor responsive to debris entering the debris canister via air drawn into the housing; and a controller coupled to the debris sensor, the controller configured to determine a fullness state of the debris canister based on feedback from the debris sensor.

14. The robotic floor cleaning system of claim 13, wherein the controller is configured to determine the fullness state as a percentage of the debris canister that is filled with debris.

15. The robotic floor cleaning system of claim 1, wherein the evacuation station further comprises:

a motor-current sensor responsive to operation of the robot vacuum; and a controller coupled to the motor-current sensor, the controller configured to determine an operational state of a filter proximate the robot vacuum based on sensory feedback from the motor-current sensor.

16. The robotic floor cleaning system of claim 1, wherein the evacuation station further comprises a wireless communications system coupled to a controller, and configured to communicate information describing a status of the evacuation station to a mobile device.

17. A method of evacuating a cleaning bin of a mobile floor cleaning robot, the method comprising:

docking the robot to a housing of an evacuation station, the robot comprising the cleaning bin, the cleaning bin being disposed within the robot and carrying debris ingested by the robot during cleaning; and a robot vacuum comprising a motor and a fan connected to the motor, and the evacuation station comprising a housing defining a platform having a suction opening; and an evacuation vacuum in fluid communication with the suction opening and operable to draw air into the evacuation station housing through the suction opening;

sealing the suction opening of the platform to an opening on an underside of the robot;

drawing air into the evacuation station housing through the suction opening by operating the evacuation vacuum; and actuating a one-way air flow valve disposed within the robot to inhibit air from being drawn through the fan of the robot vacuum by operation of the evacuation vacuum.

18. The method of claim 17, wherein actuating the valve comprises pulling a flap of the valve in an upward pivoting motion via a suction force of the evacuation vacuum.

19. The method of claim 18, wherein actuating the valve further comprises substantially sealing an air passage connecting the robot vacuum to an interior of the cleaning bin with the flap.

20. The method of claim 17, wherein drawing air into the evacuation station by operating the evacuation vacuum further comprises:

drawing a reverse airflow through the robot, the reverse airflow carrying dirt and debris from the cleaning bin, through the suction opening, and into the housing of the evacuation station.

21. The method of claim 20, wherein the robot further comprises a cleaning head assembly disposed in the opening on the underside of the robot, the cleaning head assembly comprising a pair of rollers positioned adjacent one another to form a gap therebetween, and wherein drawing a reverse airflow through the robot comprises routing the reverse airflow from the cleaning bin to pass through the gap between the rollers.

22. The method of claim 17, wherein drawing air into the evacuation station by operating the evacuation vacuum further comprises:

pulling a flap of a sealing member away from an opening along a wall of the cleaning bin via a suction force of the evacuation vacuum.

23. The method of claim 22, wherein the opening comprises one or more suction vents located along a rear wall of the cleaning bin.

24. The method of claim 22, wherein the opening comprises an exhaust port located along a side wall of the cleaning bin proximate the robot vacuum.

25. The method of claim 17, further comprising:

monitoring a robot-compatibility sensor responsive to a presence of a metallic plate located proximate a base of the cleaning bin; and in response to detecting the presence of the metallic plate, initiating operation of the evacuation vacuum.

26. The method of claim 25, wherein the robot-compatibility sensor comprises an inductive sensing component.

27. The method of claim 17, further comprising:

monitoring at least one debris sensor responsive to debris entering a detachable canister of the evacuation station via air drawn into the evacuation station housing to detect a fullness state of the canister; and in response to determining that the canister is substantially full based on the fullness state, inhibiting operation of the evacuation vacuum.

28. The method of claim 17, further comprising:

monitoring a motor-current sensor responsive to operation of the robot vacuum to detect an operational state of a filter proximate the robot vacuum; and in response to determining that the filter is dirty, providing a visual indication of the operational state of the filter to a user via a communications system.

29. A mobile floor cleaning robot, comprising:

a chassis with at least one drive wheel operable to propel the robot across a floor surface;

a cleaning bin disposed within the robot and arranged to receive debris ingested by the robot during cleaning;

a robot vacuum comprising a motor and a fan connected to the motor and configured to motivate air to flow along a flow path extending from an inlet on an underside of the robot, through the cleaning bin, to an outlet, thereby pulling debris through the inlet into the cleaning bin; and a one-way air flow valve disposed within the robot and configured to automatically close in response to air flow moving through the underside of the robot and along the flow path from the outlet to the inlet.

30. The mobile floor cleaning robot of claim 29, wherein the valve is located within the robot such that, with the valve in a closed position, the fan is substantially sealed from an interior of the cleaning bin.

31. The mobile robot of claim 29, wherein the cleaning bin comprises:

at least one opening along a wall of the cleaning bin; and a sealing member mounted to the wall of the cleaning bin in alignment with the at least one opening.

32. The mobile floor cleaning robot of claim 31, wherein the at least one opening comprises one or more suction vents located along a rear wall of the cleaning bin.

33. The mobile floor cleaning robot of claim 31, wherein the at least one opening comprises an exhaust port located along a side wall of the cleaning bin proximate the robot vacuum.

34. The mobile floor cleaning robot of claim 31, wherein the sealing member comprises a flexible and resilient flap adjustable from a closed position to an open position in response to a suction force.

35. The mobile floor cleaning robot of claim 31, wherein the sealing member comprises an elastomeric material.

36. The mobile floor cleaning robot of claim 29, wherein the robot further comprises a cleaning head assembly disposed in an opening on the underside of the robot, the cleaning head assembly comprising a pair of rollers positioned adjacent one another to form a gap therebetween, the gap being configured to receive a forward airflow carrying debris to the cleaning bin during cleaning operations of the robot and a reverse airflow carrying debris from the cleaning bin during evacuation operations of the robot.

37. A cleaning bin for use with a mobile robot, the cleaning bin comprising:

a frame attachable to a chassis of the mobile robot, the frame defining a debris collection cavity and comprising:

a vacuum housing; and a rear wall having one or more suction vents;

a vacuum sealing member coupled to the frame in an air passage proximate the vacuum housing, wherein the vacuum sealing member comprises a flexible and resilient flap adjustable from an open position to a closed position in response to a reverse suction airflow out of the cleaning bin and through an underside of the mobile robot; and an elongated sealing member coupled to the frame proximate the rear wall in alignment with the suction vents, wherein the elongated sealing member comprises a flexible and resilient flap adjustable from a closed position to an open position in response to the reverse suction airflow.

38. The cleaning bin of claim 37, further comprising an auxiliary sealing member located along a side wall of the frame in alignment with an exhaust port proximate a lower portion of the vacuum housing, and wherein the auxiliary sealing member is adjustable from a closed position to an open position in response to the reverse suction airflow.

39. The cleaning bin of claim 37, wherein the vacuum housing is oriented at an oblique angle, such that an air intake of a robot vacuum supported within the vacuum housing is tilted relative to the air passage.

40. The cleaning bin of claim 37, wherein at least one of the flap of the vacuum sealing member and the flap of the elongated sealing member comprises an elastomeric material.

41. The cleaning bin of claim 37, wherein the flap of the vacuum sealing member is located with the air passage such that, with the flap of the vacuum sealing member in a closed position, a fan of a robot vacuum supported within the vacuum housing is substantially sealed from the debris collection cavity.

42. The cleaning bin of claim 37, further comprising a passive roller mounted along a bottom surface of the frame.

43. The cleaning bin of claim 37, further comprising a bin detection system configured to sense an amount of debris present in the debris collection cavity, the bin detection system comprising at least one debris sensor coupled to a microcontroller.

* * * * *